US011268773B2

(12) United States Patent
Tonellato et al.

(10) Patent No.: US 11,268,773 B2
(45) Date of Patent: Mar. 8, 2022

(54) DUAL HEAT EXCHANGERS WITH INTEGRATED DIVERTER VALVE

(71) Applicant: Dana Canada Corporation, Oakville (CA)

(72) Inventors: Silvio E Tonellato, Hamilton (CA); Anis Muhammad, Mississauga (CA)

(73) Assignee: Dana Canada Corporation, Oakville (CA)

( * ) Notice: Subject to any disclaimer, the term of this patent is extended or adjusted under 35 U.S.C. 154(b) by 126 days.

(21) Appl. No.: 16/851,592

(22) Filed: Apr. 17, 2020

(65) Prior Publication Data

US 2021/0325131 A1 Oct. 21, 2021

(51) Int. Cl.
*F28F 27/02* (2006.01)
*F28D 9/00* (2006.01)

(52) U.S. Cl.
CPC ..... *F28F 27/02* (2013.01); *F28D 9/0093* (2013.01); *F28F 2280/06* (2013.01)

(58) Field of Classification Search
CPC ..... F28F 27/02; F28F 2280/06; F28F 9/0253; F28D 9/0093; F28D 2021/0089; F28D 2021/0094; F16H 57/0413
See application file for complete search history.

(56) References Cited

U.S. PATENT DOCUMENTS

| | | | | |
|---|---|---|---|---|
| 9,810,182 | B2 * | 11/2017 | Amaral | F01M 5/002 |
| 9,945,623 | B2 | 4/2018 | Sheppard et al. | |
| 10,087,793 | B2 * | 10/2018 | Boyer | F16H 57/0412 |
| 2018/0347686 | A1 | 12/2018 | Baaso et al. | |
| 2019/0284973 | A1 | 9/2019 | Kim et al. | |
| 2020/0149623 | A1 | 5/2020 | Muhammad et al. | |

FOREIGN PATENT DOCUMENTS

| | | | |
|---|---|---|---|
| CN | 106704685 A | * | 5/2017 |
| GB | 695014 | | 8/1953 |

* cited by examiner

*Primary Examiner* — Jianying C Atkisson
*Assistant Examiner* — Khaled Ahmed Ali Al Samiri
(74) *Attorney, Agent, or Firm* — Ridout & Maybee LLP

(57) ABSTRACT

A heat exchanger assembly includes first and second heat exchangers integrated with a thermally actuated control valve assembly having first and second surfaces to which the first and heat exchangers are attached at various orientations to each other, including at 90 and 180 degrees to each other, and side-by-side. The valve assembly has two fluid ports for connection to an external fluid source, and two fluid ports in fluid communication with inlet and outlet manifolds of each heat exchanger. The heat exchangers may be a transmission oil heater and a transmission oil cooler, and the valve assembly controls the flow of transmission oil to the heat exchangers depending on the oil temperature. One or both of the heat exchangers may be brazed or mechanically secured to the valve assembly. The housing of valve assembly may be segmented, with each heat exchanger being brazed to one of the segments.

17 Claims, 18 Drawing Sheets

80
160
14
52
146
50
160
82
160
148
470
84
164
94
104
164
166,168
96
164
70
164
388
16
164
58,152
86,98
162
162
88,100
60,154
146
162
158
150
162
160
162
162
156
12
160
160
160
80
82

DUAL HEAT EXCHANGERS WITH INTEGRATED DIVERTER VALVE

TECHNICAL FIELD

The invention relates to various heat exchanger assemblies in which two heat exchangers are integrated with a valve mechanism, such as a control valve or thermal bypass valve.

BACKGROUND

In the automobile industry, for example, control valves and/or thermal valves are often used in combination with heat exchangers to either direct a fluid to a heat exchanger unit to be cooled/heated, or to direct the fluid elsewhere in the fluid circuit within the automobile system, to "bypass" the heat exchanger. Control valves or thermal valves are also used within automobile systems to sense the temperature of a particular fluid and direct it to an appropriate heat exchanger, for either warming or cooling, to ensure the fluids circuiting through the automobile systems are within desired temperature ranges.

It is known to incorporate a control valve or thermal bypass valve into a heat exchange system where the valve is connected to two heat exchangers, one for heating a fluid and another for cooling the fluid. In some systems, one heat exchanger is integrated with the valve, and another heat exchanger is remotely located and connected to the valve by means of external fluid lines, for example as disclosed in commonly assigned U.S. Pat. No. 9,945,623 (Sheppard et al.) and in U.S. Pat. No. 10,087,793 (Boyer et al.). External fluid lines require various parts/components which increase the number of individual fluid connections in the overall heat exchange system. This not only adds to the overall costs associated with the system, but also gives rise to multiple potential points of failure and/or leakage. Size constraints are also a factor within the automobile industry, with a trend towards more compact units or component structures.

Accordingly, there is a need for improved heat exchanger assemblies that offer improved connections between the control valves and the associated heat exchanger, and that can also result in more compact, overall assemblies.

SUMMARY OF THE PRESENT DISCLOSURE

In accordance with an aspect of the present disclosure, there is provided a heat exchanger assembly comprising: (a) a first heat exchanger; comprising a core having a top and a bottom, the bottom of the core having first and second manifold openings; and (b) a second heat exchanger. The first and second heat exchangers each comprise a core having a top and a bottom, the bottom of the core having first and second manifold openings.

The heat exchanger assembly further comprises (c) a control valve comprising a valve housing and first and second valve elements, the valve housing comprising: (i) a first surface to which the first heat exchanger is attached; (ii) a second surface to which the second heat exchanger is attached; (iii) first and second fluid ports for connection to an external source of a first fluid; (iv) third and fourth fluid ports provided in the first surface of the valve housing, the third fluid port providing fluid communication between the first fluid port and the first manifold opening of the first heat exchanger, and the fourth fluid port providing fluid communication between the second fluid port and the second manifold opening of the first heat exchanger; (v) fifth and sixth fluid ports provided in the second surface of the valve housing, the fifth fluid port providing fluid communication between the first fluid port and the first manifold opening of the second heat exchanger, and the sixth fluid port providing fluid communication between the second fluid port and the second manifold opening of the second heat exchanger; (vi) a first valve chamber in flow communication with the first or second manifold opening of the second heat exchanger, wherein the first valve element is configured to selectively block or allow flow of the first fluid through the first valve chamber to or from the second heat exchanger; and (vii) a second valve chamber in flow communication with the first or second manifold opening of the first heat exchanger, wherein the second valve element is configured to selectively block or allow flow of the first fluid through the second valve chamber to or from the other heat exchanger.

In another aspect, the second, fourth and sixth fluid ports all open into a first interior space of the valve housing, the first interior space being in fluid communication with the first and second heat exchangers through the fourth and sixth fluid ports; and wherein the first, third and fifth fluid ports all open into a second interior space of the valve housing, the second interior space being in fluid communication with the first and second heat exchangers through the third and fifth fluid ports.

In another aspect, the first and second interior spaces are spaced apart from one another along a longitudinal axis and are fluidly isolated from one another.

In another aspect, the first and second valve elements and the first and second valve chambers are located within the second interior space, and wherein the first valve element and the first valve chamber are spaced apart from the second valve element and the second valve chamber along the longitudinal axis.

In another aspect, the control valve includes a first valve seat located between the first fluid port and the fifth fluid port, wherein the first valve element is movable between a first position in which it sealingly engages the first valve seat to block fluid flow through the first valve chamber, and a second position in which it is spaced from the first valve seat to permit fluid flow through the first valve chamber; and wherein the control valve includes a second valve seat located between the first fluid port and the third fluid port, wherein the second valve element is movable between a first position in which it is spaced from the second valve seat to permit fluid flow through the second valve chamber, and a second position in which it sealingly engages the second valve seat to block fluid flow through the second valve chamber.

In another aspect, the first and second valve elements are spaced apart along a longitudinal axis and are movable along the longitudinal axis; wherein the first and second valve elements are both attached to a thermal actuator which is located between the first and second valve seats; and wherein the first and second valve elements are movable together along with the actuator between their respective first and second positions.

In another aspect, the valve housing further comprises a third valve chamber located between the first and second valve chambers, wherein the third valve chamber contains an interior opening of the first oil port, and also contains the thermal actuator.

In another aspect, the valve body and the second heat exchanger comprise a unitary first sub-assembly, the components of which are joined by brazing; and wherein the first heat exchanger is mechanically secured to the first surface of the valve housing.

In another aspect, the bottom of the first heat exchanger is joined to a first surface of an adapter plate, wherein the first heat exchanger and the adapter plate comprise a unitary second sub-assembly, the components of which are joined by brazing; wherein the adapter plate has a second surface which is mechanically sealed to the first surface of the valve housing, the adapter plate comprising a pair of openings to provide fluid communication between the third and fourth oil ports and the first and second manifold openings of the first heat exchanger.

In another aspect, the adapter plate includes a peripheral edge extending outwardly of a periphery of the first heat exchanger, the peripheral edge having a plurality of apertures which align with threaded bores in the valve body, and wherein the adapter plate is secured to the valve body by a plurality of threaded fasteners.

In another aspect, the third and fourth oil ports are offset from the respective first and second manifold openings of the first heat exchanger; wherein the adapter plate includes a pair of transfer channels, each of the transfer channels comprising of trough protruding away from the bottom of the heat exchanger and extending parallel to the bottom of the first heat exchanger from one of the third and fourth oil ports to the associated first or second manifold opening of the first heat exchange; and wherein the first surface of the valve body includes a recessed portion in which the third and fourth oil ports are provided, the recessed portion receiving the transfer channels of the adapter plate.

In another aspect, the first and second surfaces are located on opposite sides of the valve body and are parallel to one another, such that the first and second heat exchangers are located on opposite sides of the valve body; and wherein the valve body further comprises a third surface in which at least one of the first and second ports are provided.

In another aspect, the first heat exchanger is brazed or mechanically secured to the first surface of the valve housing, and the second heat exchanger is brazed or mechanically secured to the second surface of the valve housing.

In another aspect, the first and second surfaces of the valve housing are arranged at about 90 degrees to one another, such that the first and second heat exchangers are arranged at about 90 degrees to one another; and wherein the valve body further comprises a third surface in which the first and second ports are provided, wherein the third surface is arranged at about 180 degrees to one of the first and second surfaces.

In another aspect, the heat exchanger assembly comprises a first sub-assembly and a second sub-assembly, and the valve housing comprises a first valve housing segment and a second valve housing segment; wherein the first valve housing segment includes the first surface of the valve housing and the second valve housing segment includes the second surface of the valve housing; wherein the first sub-assembly comprises the first heat exchanger and the first valve housing segment, and the second sub-assembly comprises the second heat exchanger and the second valve housing segment; wherein the first valve housing segment includes a first connection surface and the second valve housing segment includes a second connection surface; and wherein the first and second sub-assemblies are mechanically joined together along the first and second connection surfaces.

In another aspect, the first and second valve elements, the first and second valve chambers, and the first and second fluid ports are all located in the second valve housing segment.

In another aspect, the third and fourth oil ports extend across the first and second connection surfaces.

In another aspect, the first surface of the first valve housing segment is at 90 degrees to the first connection surface, and the second surface of the second valve housing segment is at 90 degrees to the second connection surface, such that the first and second surfaces are side-by-side.

In another aspect, each of the third and fourth oil ports includes a 90 degree bend.

In another aspect, the heat exchanger assembly further comprises: a bypass flow passage providing fluid communication between the first interior space and the second interior space; and a pressure-actuated bypass valve element to selectively block or allow flow of the first fluid through the bypass flow passage from the first interior space to the second interior space; wherein the bypass valve element is actuated by a high pressure condition in which there is a predetermined pressure drop between the first interior space and the second interior space.

BRIEF DESCRIPTION OF THE DRAWINGS

Exemplary embodiments of the present disclosure will now be described, by way of example, with reference to the accompanying drawings, in which.

DETAILED DESCRIPTION OF EXEMPLARY EMBODIMENTS

Figure 1:
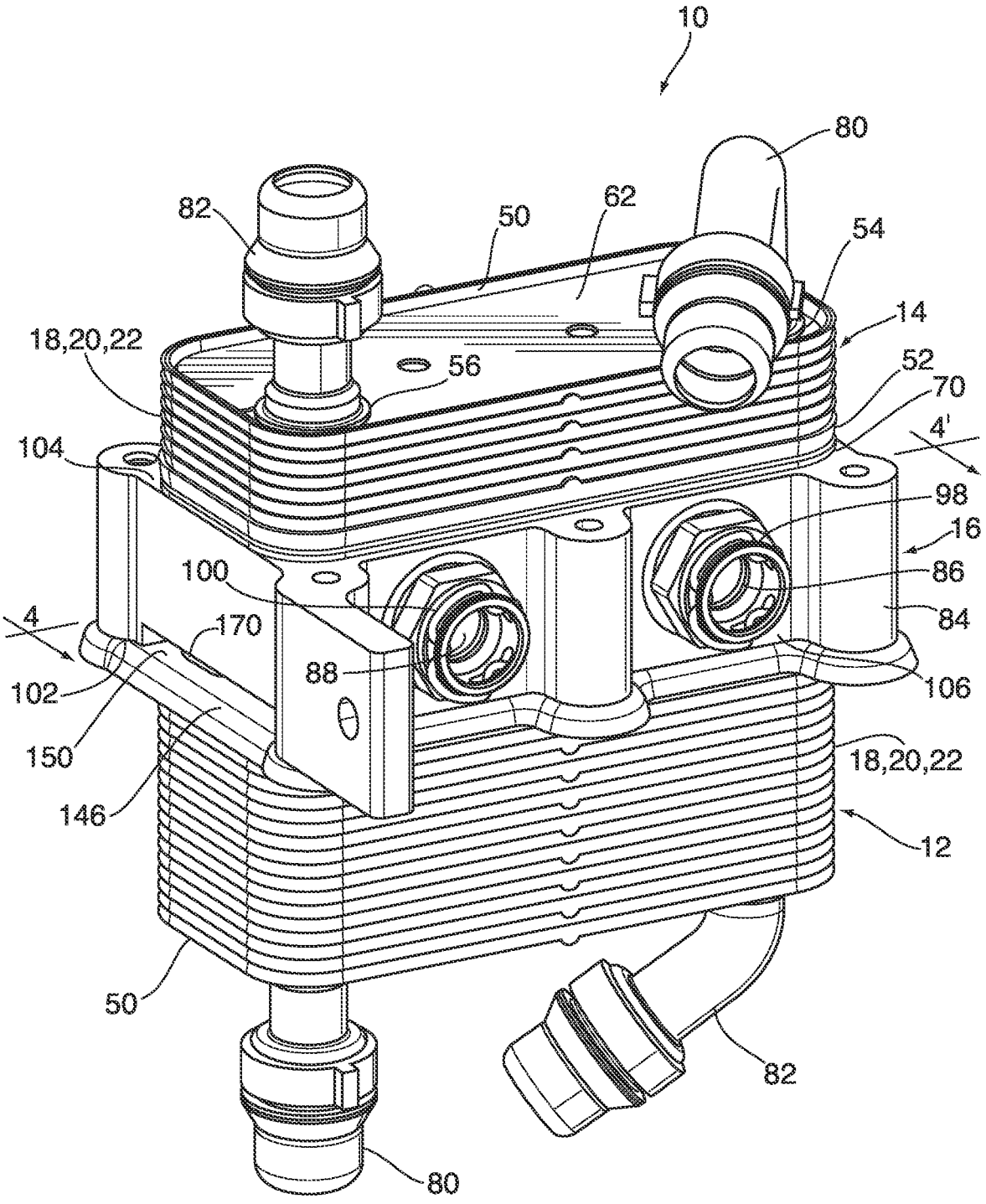
FIG. 1 is a perspective view of a heat exchanger assembly according to a first embodiment.

A heat exchanger assembly 10 according to a first embodiment is now described with reference to FIGS. 1-5C.

Heat exchanger assembly 10 comprises a first heat exchanger 12, a second heat exchanger 14 and a thermal valve assembly 16.

First heat exchanger 12 is comprised of a plurality of stamped heat exchanger core plates 18, 20 disposed in alternating, stacked, brazed relation to one another to form a heat exchanger core 22, with alternating first and second fluid flow passages 24, 26 formed between the stacked core plates 18, 20. The first fluid flow passages 24 are for flow of a first heat transfer fluid, and the second fluid flow passages 26 are for flow of a second heat transfer fluid. In the present embodiment, the first heat transfer fluid (also referred to herein as the "first fluid" or "oil") is a transmission oil, and the second heat transfer fluid (also referred to herein as the "second fluid" or "coolant") is engine coolant, which typically comprises glycol or a glycol/water mixture. In other embodiments, the first heat transfer fluid may be engine oil. In the present embodiment, the first heat exchanger 12 is provided for transferring heat from the coolant to the transmission oil, and is therefore also referred to herein as a transmission oil heater or "TOH".

Figure 3:
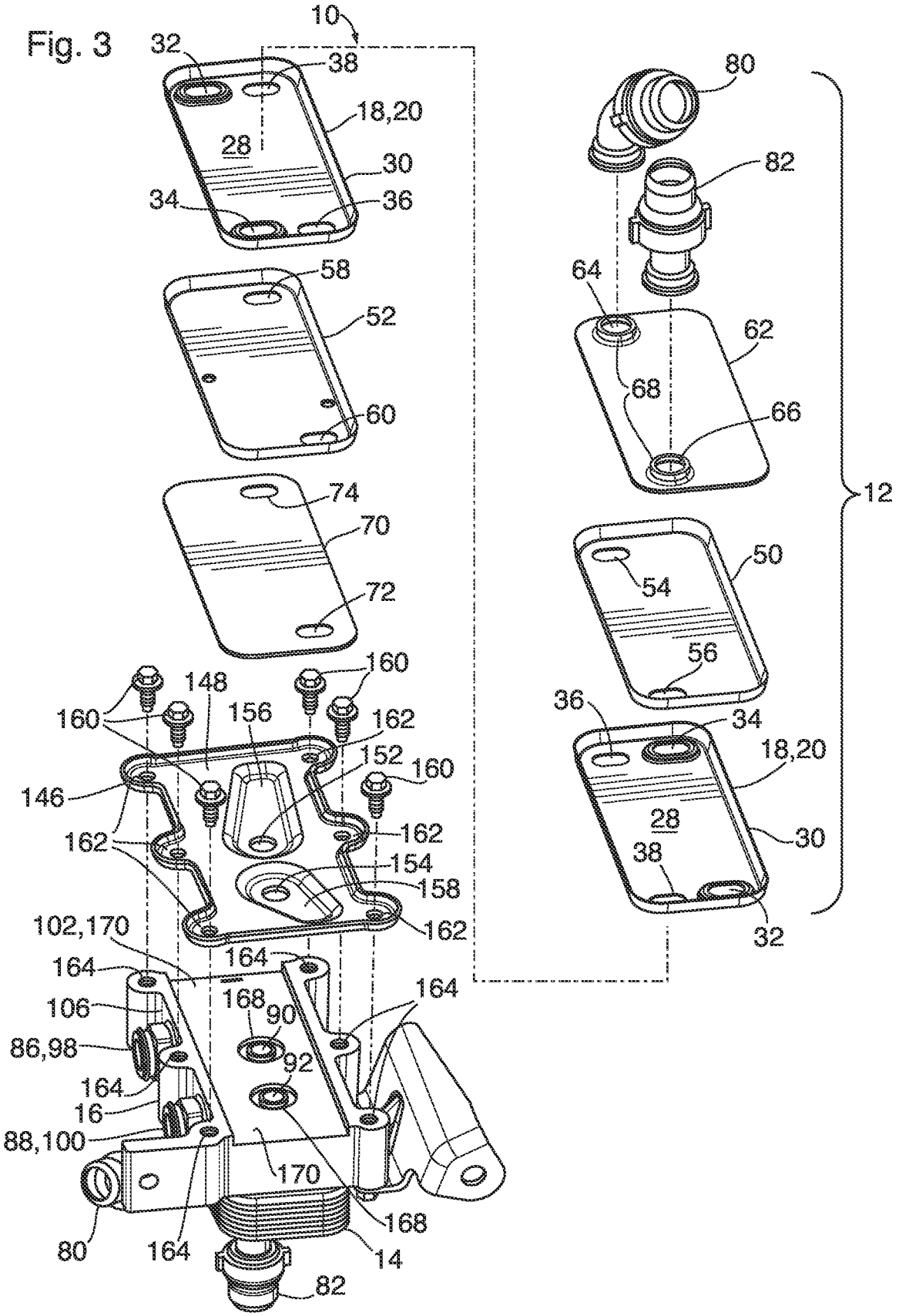
FIG. 3 is a perspective view the heat exchanger assembly of FIG. 1 with the first heat exchanger in a disassembled state.

The core plates 18, 20 may be identical to one another, with the alternating arrangement of core plates 18, 20 being provided by rotating every other core plate 18, 20 in the stack by 180 degrees (i.e. end-to-end), relative to adjacent core plates 18, 20 in the stack. The partially disassembled view of FIG. 3 shows some of the core plates 18, 20, however, most of the core plates of heat exchanger 12 are not shown in FIG. 3.

The core plates 18, 20 each comprise a generally planar base portion 28 surrounded on all sides by sloping edge walls 30. The core plates 18, 20 are stacked one on top of another with their edge walls 30 in nested, sealed engagement. Each core plate 18, 20 is provided with four holes 32, 34, 36, 38 near its four corners, each of which serves as an inlet hole or an outlet hole for the first or second heat transfer fluid as required by the particular application. Two holes 32, 34 are raised with respect to the base portion 28 of the core plate 18, 20, and are formed in a raised boss which has a flat sealing surface surrounding the holes 32, 34. The other two holes 36, 38 are co-planar or flush with the base portion 28 of the plate 18, 20. The two raised holes 32, 34 are arranged at opposite ends of core plate 18, 20, and the two flush holes 36, 38 are similarly arranged at opposite ends of the core plate 18, 20.

The raised holes 32, 34 in one core plate 18 or 20 align with the flush holes 36, 38 of an adjacent core plate 18 or 20, with the flat sealing surface surrounding the raised holes 32, 34 sealing against the area of base portion 28 surrounding the flush holes 36, 38 of the adjacent core plate 18 or 20. This engagement between the core plates 18, 20 spaces apart the base portions 28 of adjacent core plates 18, 20, thereby defining the alternating first and second fluid flow passages 24, 26. Each fluid flow passage 24 or 26 will have inlet and outlet openings defined by the flush holes 36, 38, which are aligned with the raised holes 32, 34 of an adjacent core plate 18, 20.

Each fluid flow passage 24, 26 may be provided with a turbulizer sheet 40 (shown only in FIG. 8), to improve heat transfer, as known in the art. Alternatively, the core plates 18, 20 may include heat transfer augmentation features (not shown), such as ribs and/or dimples formed in the planar base portion 28 of the core plates 18, 20, as known in the art.

The holes 32, 34, 36, 38 in the core plates 18, 20 are aligned to form a first manifold 42 and a second manifold 44 coupled together by the first fluid flow passages 24, and a third manifold 46 and fourth manifold 48 coupled together by the second fluid flow passages 26. Either the first or second manifold 42, 44 may be the oil inlet manifold or the oil outlet manifold, and either the third or fourth manifold 46, 48 may be the coolant inlet manifold or the coolant outlet manifold, depending on the desired direction of flow through the heat exchanger 12. Also, the flow direction of the first heat transfer fluid in the first fluid flow passages 24 may be the same ("co-flow") or opposite ("counter-flow") to the flow direction of the second heat transfer fluid in the second fluid flow passages 26.

The core plates 18, 20 in the core 22 are enclosed between top and bottom plates 50, 52 (also referred to herein as "end plates"). Together, the top and bottom plates 50, 52 close one end of each manifold 42, 44, 46, 48 and provide a conduit opening at the other end of the manifold 42, 44, 46, 48. In the present embodiment, top plate 50 has two conduit openings 54, 56, which define inlet and outlet openings for the second heat transfer fluid (coolant), while the bottom plate 52 has two conduit openings 58, 60, which define inlet and outlet openings for the first heat transfer fluid (oil). The terms "top" and "bottom" are used herein for convenience only, with the bottom of each heat exchanger 12, 14 being proximate to valve assembly 16, and the top of each heat exchanger 12, 14 being distal to valve assembly 16.

The top plate 50 may generally have the same shape as core plates 18, 20, with a planar base portion 28 and a sloping edge wall 30, with its two conduit openings 54, 56 flush with the planar base portion 28 and aligned with the two flush holes 36, 38 of the immediately adjacent core plate 18 or 20. Thus, the top plate 50 is configured to permit the second heat transfer fluid (coolant) to enter and exit the third and fourth manifolds 46, 48 of heat exchanger 12 through its two conduit openings 54, 56 at the top of the heat exchanger 12, while the planar base portion 28 of top plate 50 seals the top ends of the first and second manifolds 42, 44.

In the present embodiment the top of first heat exchanger 12 is provided with a pair of tubular fittings 80, 82 through which the second fluid (coolant) enters and leaves the heat exchanger 12. The tubular fittings 80, 82 are configured for connection to hoses or tubes (not shown) in the vehicle's coolant circulation system. The fittings 80, 82 are in fluid communication with the conduit openings 54, 56 and are sealingly joined to top plate 50, optionally through a fitting adapter plate 62 comprising a pair of openings 64, 66 which are aligned with the conduit openings 54, 56. The fitting adapter plate 62 is flat except for upstanding collars 68, which surround openings 64, 66 and extend into the bases of fittings 80, 82. The fitting adapter plate 62 fits inside the edge wall 30 of top plate 50 and is brazed to the base portion 28 thereof. It will be appreciated that fitting adapter plate 62 is optional.

As shown in FIG. 3, bottom plate 52 may generally have the same shape as core plates 18, 20, having a generally planar base portion 28 and a sloping edge wall 30. Bottom plate 52 has two conduit openings 58, 60 flush with the planar base portion 28 and aligned with the two flush holes 36, 38 of the immediately adjacent core plate 18 or 20. Thus, the bottom plate 52 is configured to permit the first heat transfer fluid (oil) to enter and exit the first and second manifolds 42, 44 of heat exchanger 12 through its two conduit openings 58, 60 at the bottom of the heat exchanger 12, while the planar base portion 28 of bottom plate 52 seals the bottom ends of the third and fourth manifolds 46, 48.

Figure 2:
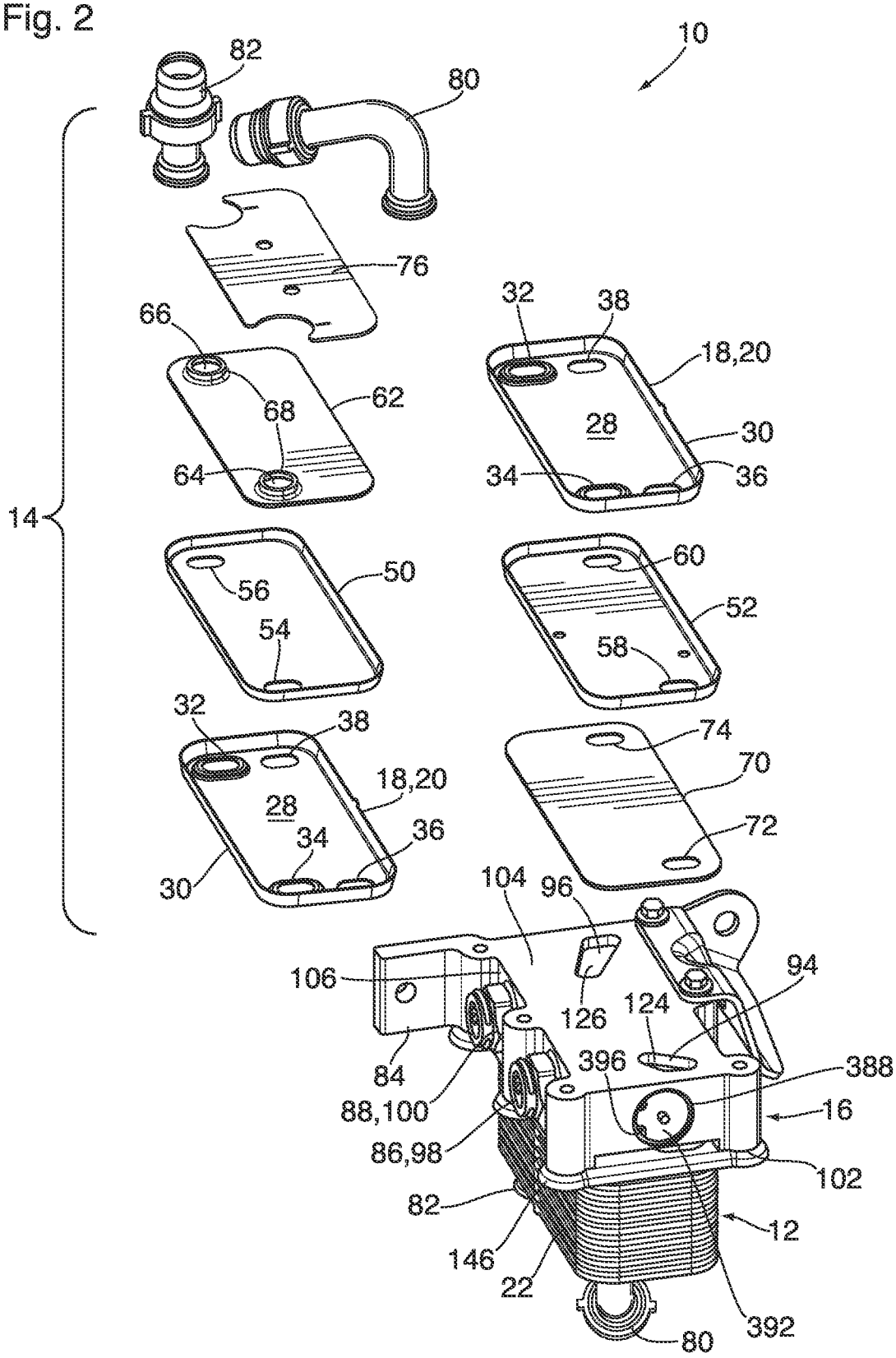
FIG. 2 is a perspective view of the heat exchanger assembly of FIG. 1 with the second heat exchanger in a disassembled state.

The second heat exchanger 14 is similar in structure to the first heat exchanger 12, and the components of heat exchanger 14 are best seen in the partially disassembled view of FIG. 2. In the present embodiment, the cores 22 of first and second heat exchangers 12, 14 include many of the same components, which are identified herein with the same reference numerals. The above description of these like-numbered components of first heat exchanger 12 applies equally to second heat exchanger 14. However, it can be seen from the drawings that the first and second heat exchangers 12, 14 differ in height because they include different numbers of core plates 18, 20, due to different heating/cooling requirements in each heat exchanger 12, 14. In the present embodiment, the first heat exchanger 12 includes more core plates 18, 20 than second heat exchanger 14.

The second heat exchanger 14 is provided for transferring heat from the first heat transfer fluid (oil) to the second heat transfer fluid (coolant), and is therefore also referred to herein as a transmission oil cooler or "TOC". It will be appreciated that FIG. 2 shows only some of the core plates 18, 20, and most of the core plates are not shown therein. FIG. 2 also shows an optional shim plate 76 which may be provided on top of fitting adapter plate 62 to provide brazing filler metal for brazing fittings 80, 82 to plate 62. A corresponding shim plate (not shown) may also be provided in first heat exchanger 12.

The thermal valve assembly 16 is also referred to herein as a control valve or a diverter valve. In the present embodiment, the valve assembly 16 is integrated with, and positioned between, the first and second heat exchangers 12, 14, with the first and second heat exchangers 12, 14 arranged on opposite sides of the valve assembly 16, i.e. at about 180 degrees to each other. However, it will be appreciated that the angle between the heat exchangers may be more or less than 180 degrees, depending on the specific application.

The valve assembly 16 includes a valve housing 84 which may have a unitary, one-piece construction, and may be formed by casting, extrusion, forging and/or machining. The housing 84 includes first to sixth oil ports 86, 88, 90, 92, 94 and 96 for receiving and discharging the first heat transfer fluid. All six ports are defined by an exterior opening and an interior opening connected by a flow passage, as further discussed below.

The first and second oil ports 86, 88 are provided for connecting the valve assembly 16 to an external source of first heat transfer fluid. As further discussed below, the first and second oil ports 86, 88 are directly or indirectly connected to an automatic transmission, within a fluid circulation system of a vehicle having an internal combustion engine. The first and second oil ports 86, 88 may be internally threaded proximate to their exterior openings, for engagement with externally threaded fluid connection fittings such as quick-connect fittings 98, 100, although any type of suitable fitting construction may be used.

The third and fourth oil ports 90, 92 are provided for fluid connection to the conduit openings 58, 60 of the bottom plate 52 of first heat exchanger 12, with the exterior openings of oil ports 90, 92 both being provided in a first surface 102 of housing 84, which is further described below.

The fifth and sixth oil ports 94, 96 are provided for fluid connection to the conduit openings 58, 60 of the bottom plate 52 of second heat exchanger 14, and the exterior openings of oil ports 94, 96 are both provided in a second surface 104 of housing 84, which is further described below. As shown in the drawings, the first and second surfaces 102, 104 are substantially flat and parallel to each other, and face in opposite directions. Also, in the present embodiment, the exterior openings of first and second oil ports 86, 88 are both provided in a third surface 106 which is located between surfaces 102, 104 and at about 90 degrees thereto. However, it is not required that oil ports 86, 88 are located in the same surface 106, or that this surface is arranged at 90 degrees to the first and second surfaces 102, 104. Rather, the surface 106 can be oriented at more or less than 90 degrees to each of the surfaces 102, 104.

Figure 5A:
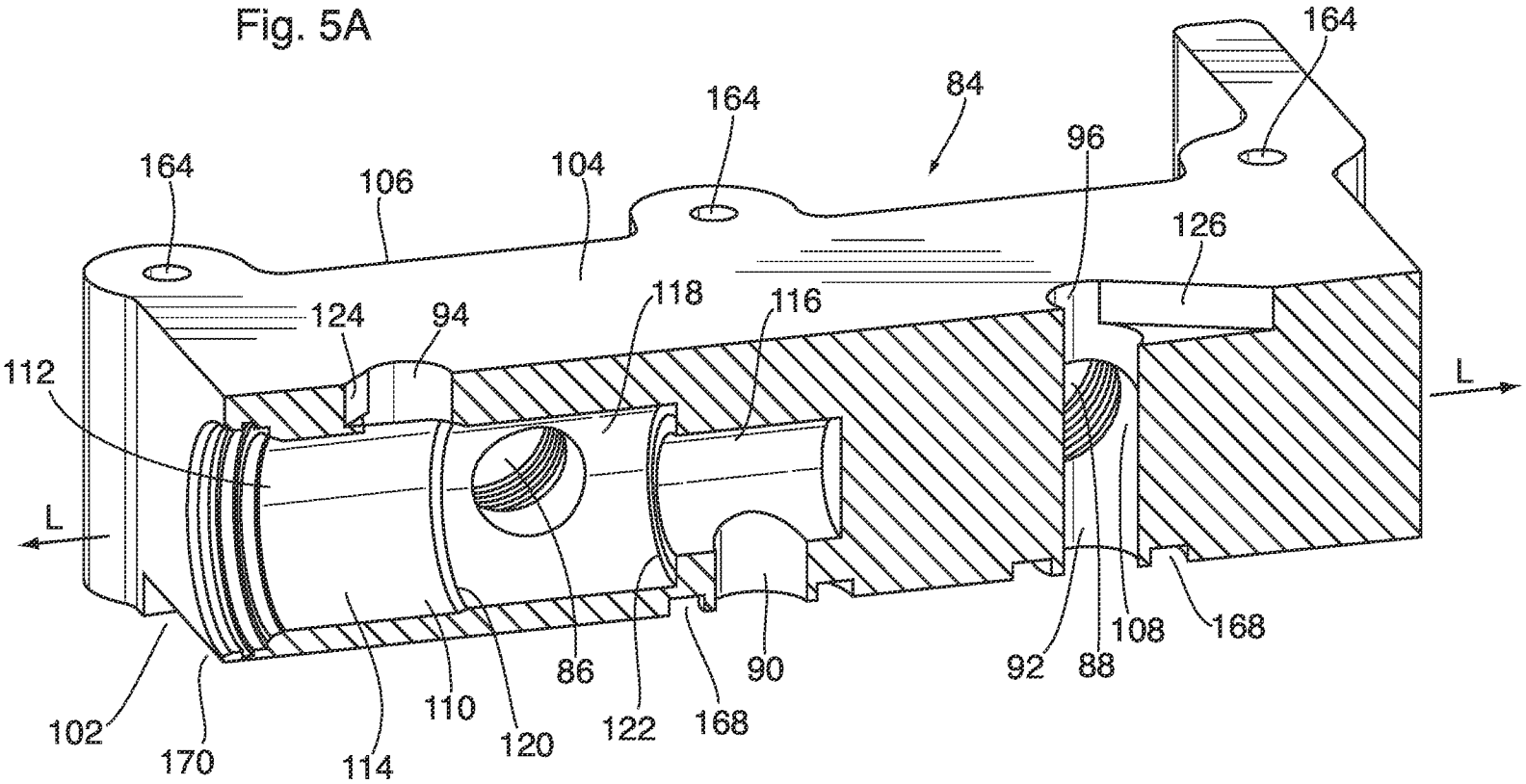
FIG. 5A is an isolated cross-sectional view of the valve body, along line 4-4' of FIG. 1.

It can be seen from the drawings, particularly the isolated view of FIG. 5A, that the valve housing 84A, with its flat, parallel, opposed surfaces 102, 104, and with its side surfaces orthogonal thereto, is amenable to being produced by extrusion, i.e. with the direction of extrusion being orthogonal to surfaces 102, 104 and parallel to the adjoining side surfaces. Extrusion of valve housing 84 may be advantageous for manufacturing large quantities of valve housings 84.

Figure 4:
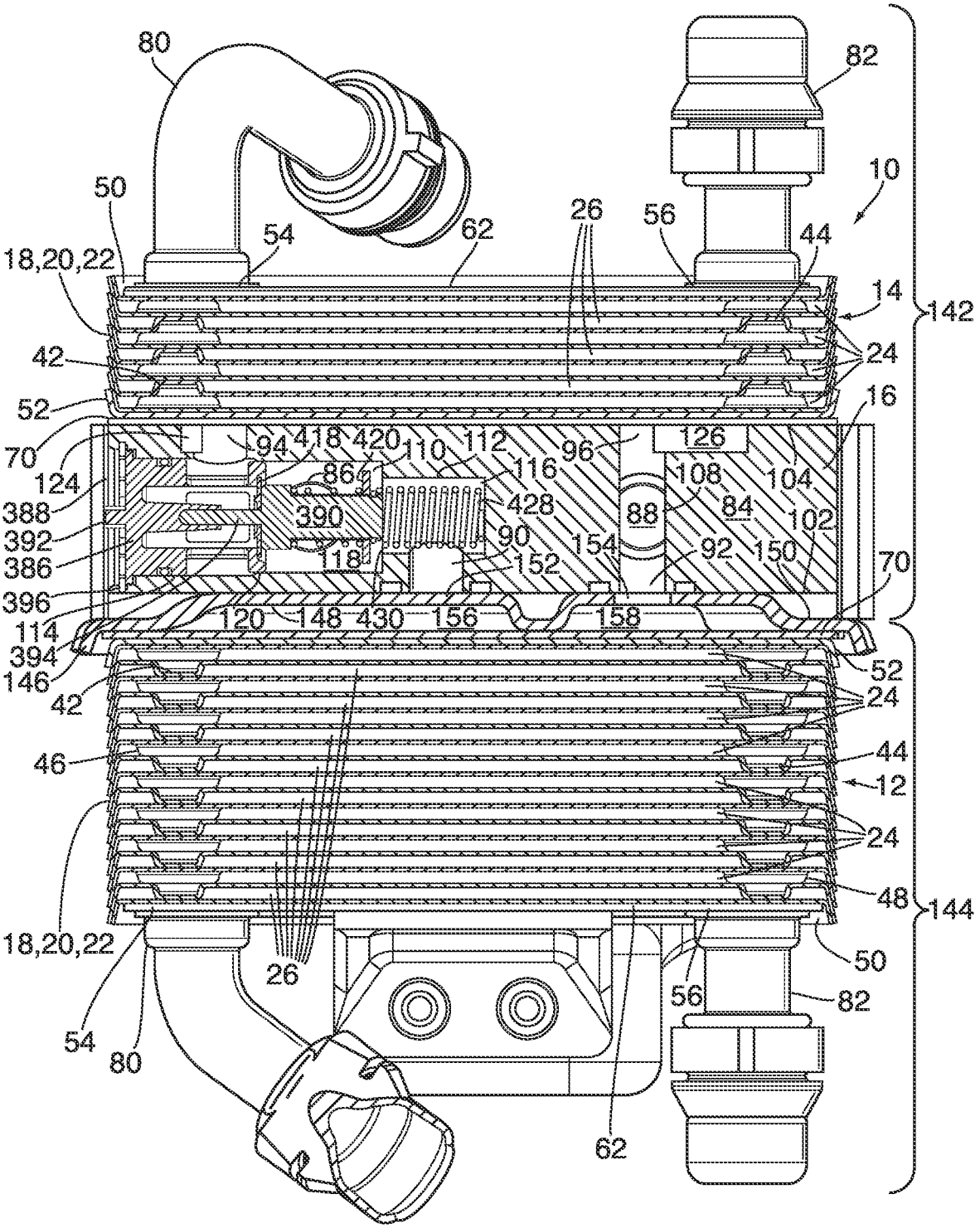
FIG. 4 is a cross-section along line 4-4' of FIG. 1, with the valve in a cold state.

As shown in FIGS. 4 and 5A, the second oil port 88 is in fluid communication with both the fourth oil port 92 and the sixth oil port 96, wherein these three ports 88, 92, 96 all open into a first interior space 108 of housing 84, and which defines the interior openings of ports 88, 92, 96. The first interior space 108 is therefore in fluid communication with both heat exchangers 12, 14 through the fourth and sixth oil ports 92, 96. The first interior space 108 may comprise a plurality of intersecting bores, including one straight bore extending between the first and second surfaces 102, 104 of housing 84 and defining the flow passages of oil ports 92, 96, and another straight bore extending inwardly from the third surface 106 and defining the flow passage of second oil port 88. In the present embodiment the first interior space 108 may define an inlet chamber into which the oil is received through the second oil port 88, and then distributed into either the first or second heat exchangers 12, 14 through fourth port 92 or sixth port 96. However, the direction of oil flow may be reversed so that the first interior space 108 comprises an outlet chamber into which the oil is received from the first or second heat exchangers 12, 14, and then discharged through the second oil port 88.

It can also be seen from FIGS. 4 and 5A that the first oil port 86 is in fluid communication with both the third oil port 90 and the fifth oil port 94, wherein these three ports all open into a second interior space 110 of housing 84. The second interior space 110 is therefore in fluid communication with both heat exchangers 12, 14 through the third and fifth oil ports 90, 94. The second interior space 110 may comprise a plurality of intersecting bores, including a longitudinally-extending valve bore 112 which extends inwardly from an open end of the valve body 84, as well as the bores defining the flow passages of each of the first, third and fifth oil ports 86, 90, 94. The first and second interior spaces are spaced apart along a longitudinal axis L (FIG. 5A) and are fluidly isolated from one another, meaning that they are not connected by a fluid flow path within valve body 84.

As best seen in FIG. 5A, the valve bore 112 is comprised of first, second and third valve chambers 114, 116 and 118. The valve chambers are arranged along longitudinal axis L inwardly from the open end 388 of the valve bore 112, with the third valve chamber 118 being located between the first valve chamber 114 and the second valve chamber 116. Each of the valve chambers 114, 116, 118 contains an interior opening of one of the first, third and fifth oil ports 86, 90, 94, respectively. In the present embodiment, the first valve chamber 114 includes the interior opening of the fifth oil port 94; the third (middle) valve chamber 118 includes the interior opening of the first oil port 86; and the second valve chamber 116 includes the interior opening of the third oil port 90.

The first, third and second valve chambers 114, 118, 116 of the valve bore 112 are sequentially arranged along the longitudinal axis L. The first and third valve chambers 114, 118 are separated from one another by a first shoulder 120 and the second and third valve chambers 116 and 118 are separated by a second shoulder 122. The shoulders 120, 122 do not themselves block fluid flow between the valve chambers 114, 116, 118, however, the second shoulder 122 functions as an annular valve seat, as further described below. The valve bore 112 is therefore in the form of a stepped bore, and is progressively reduced in diameter at each of the first and second shoulders 120, 122.

The valve bore 112 of the second interior space 110 houses a thermal valve mechanism 386 for controlling flow of oil between the first to sixth oil ports 86, 88, 90, 92, 94, 96. The housing 84 includes a valve insertion opening 388 at the open end of the valve bore 112, permitting the insertion of the thermal valve mechanism 386 into the valve bore 112 after brazing together other components of assembly 10, as further described below.

Figure 5B:
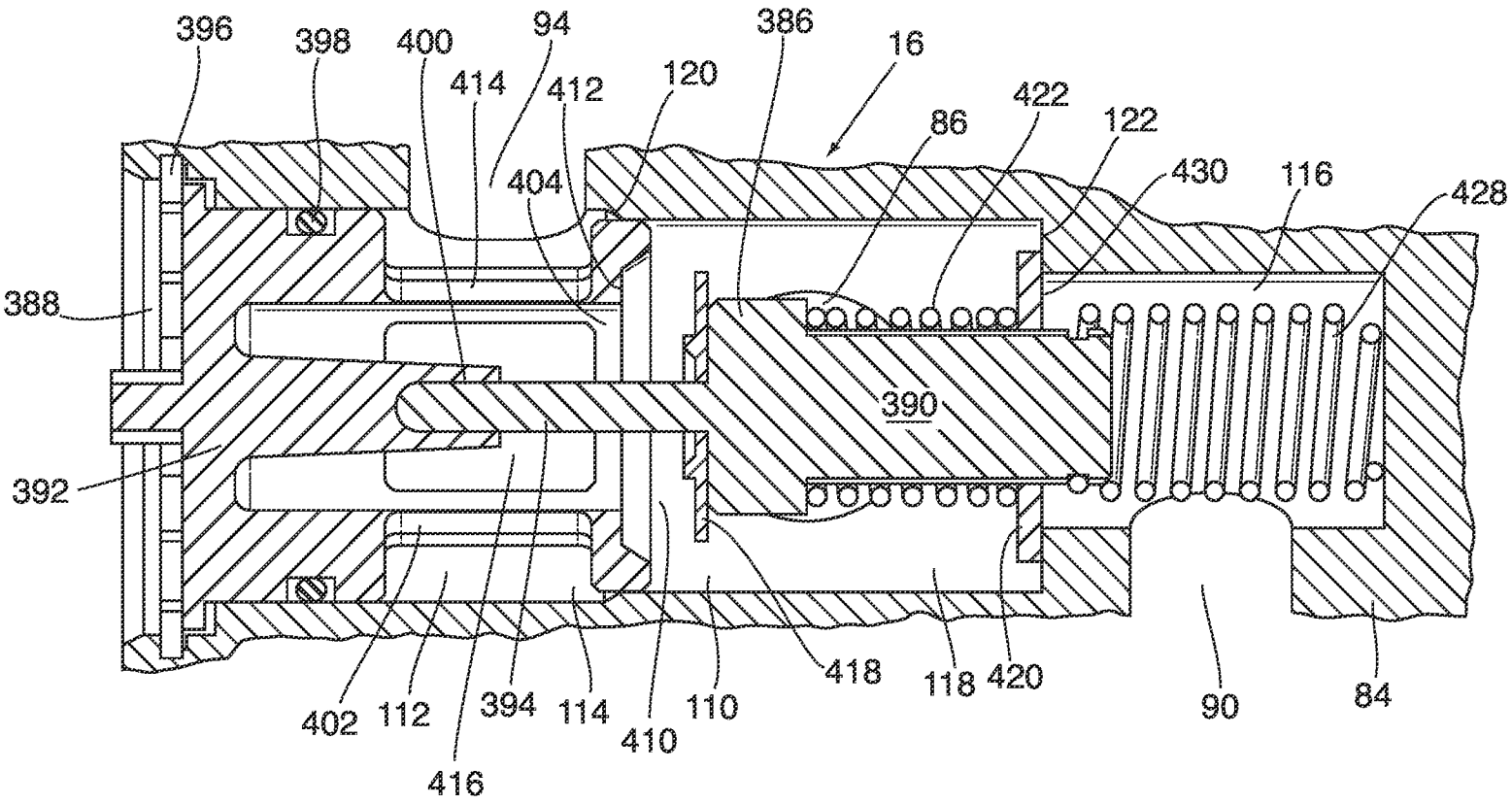
FIG. 5B is a close-up view of the valve mechanism of FIG. 4, showing the valve in a hot state.
Figure 5C:
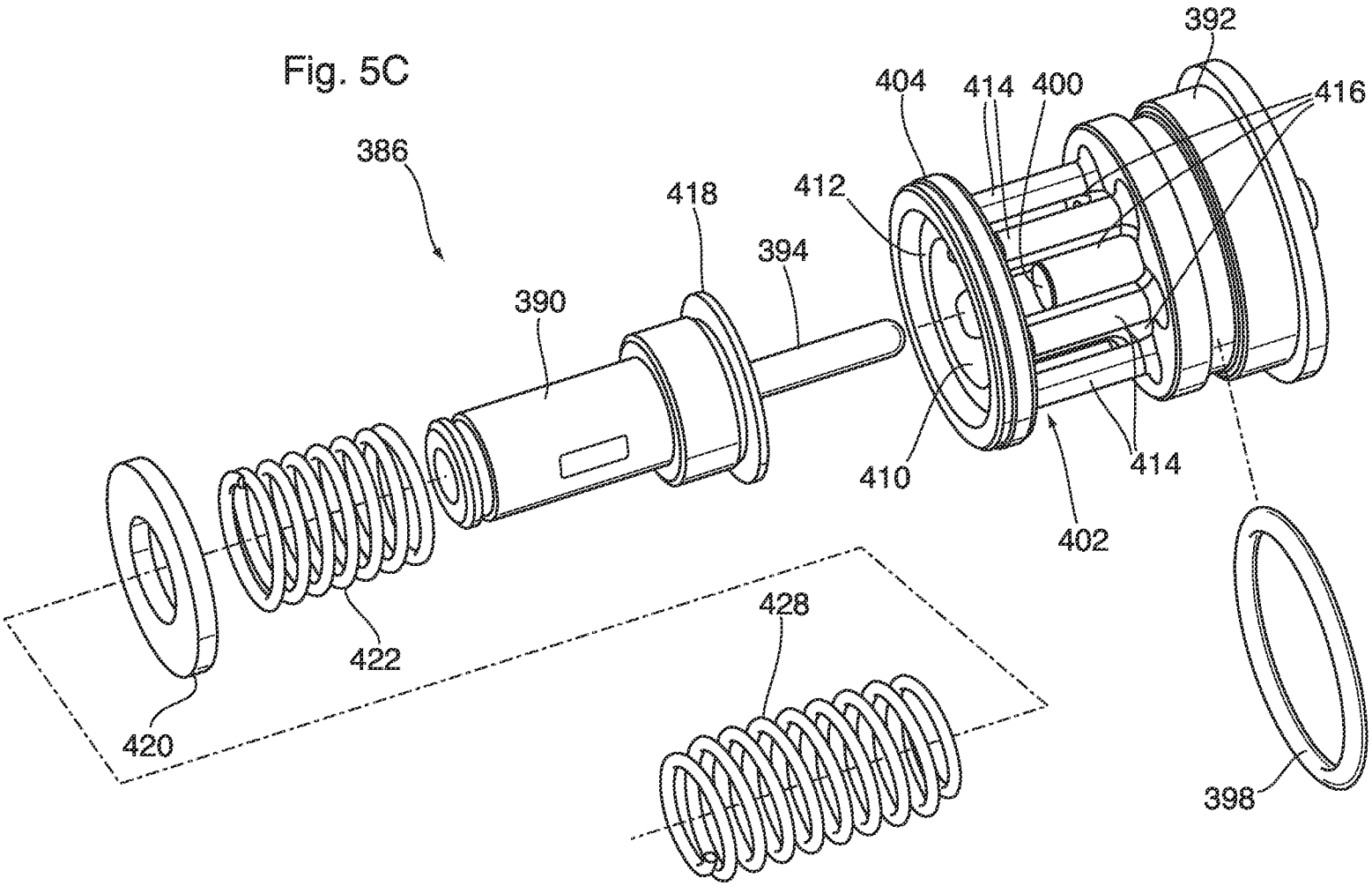
FIG. 5C is an enlarged view of the components of the valve mechanism of FIG. 4.

The individual components of thermal valve mechanism 386 are best seen in FIG. 5C. Valve mechanism 386 includes a thermal or temperature responsive actuator 390 (i.e. a wax motor or an electronic valve mechanism such as a solenoid valve or any other suitable valve mechanism). A valve cap 392 seals the valve mechanism 386 and sealingly closes the valve insertion opening 388. In the illustrated embodiment, the actuator 390 is a thermal actuator including an actuator piston 394 moveable between a first position and a second position by means of expansion/contraction of a wax (or other suitable material) contained in the actuator 390. The wax expands/contracts when it is heated/cooled by contact with oil flowing through the valve bore 112, and the wax is selected so that it expands at a specific temperature, typically ranging from about 50-90 degrees Celsius, but dependent on the specific application. The body of actuator 390 is positioned in the third valve chamber 118 in close proximity to the first oil port 86, and is therefore in contact with oil flowing into or out of the first oil port 86, depending on the direction of oil flow. Instead of a wax motor, the actuator piston 394 may be controlled by activation of a solenoid coil or any other suitable valve activation means.

The valve cap 392 is retained within valve insertion opening 388 by a resilient spring clip 396 which is received inside an annular groove located at the valve insertion opening 388, and abuts against an outer face of the valve cap 392. The cap 392 is sealed within opening 388 by a resilient sealing element such as an O-ring 398 received between an outer surface of the valve cap 392 and an inner surface of the valve bore 112, with the O-ring 398 being received in a groove in the outer surface of valve cap 392.

The valve cap 392 includes a depression 400 on its inner face in which the end of the piston 394 is received, and valve mechanism 386 further includes a spool member 402 integrated with the valve cap 392. The spool member 402 has an annular end portion 404 sealingly engaged with the valve bore 112 in the vicinity of first shoulder 120, and defines a circular first valve opening 410 surrounded by an annular first valve seat 412.

The spool member 402 further comprises a plurality of spaced-apart longitudinal ribs 414 joining the valve cap 392 to the annular end portion 404, wherein flow openings 416 are defined between the ribs 414, to allow fluid communication between first valve opening 410 and first oil port 86. As shown in FIGS. 4 and 5B, the annular end portion 404, the first valve seat 412 and the first valve opening 410 are located at or proximate to the first shoulder 120 separating the first and third valve chambers 114, 118.

The valve mechanism 386 further comprises a first valve element 418 and a second valve element 420. The first valve element 418 is configured to selectively block or allow oil flow through the first valve chamber 114 between the first oil port 86 and one of the heat exchangers 12, 14, specifically the second heat exchanger 14 in the present embodiment. The second valve element 420 is configured to selectively block or allow oil flow through the second valve chamber 116 between the first oil port 86 and the other one of the heat exchangers 12, 14, specifically the first heat exchanger 12 in the present embodiment.

In the present embodiment the first and second valve elements 418, 420 are both connected to the valve actuator 390, and are both displaced longitudinally when the valve actuator 390 is longitudinally displaced. In this regard, first valve element 418 comprises an annular disc which is carried on a first end of the valve actuator 390, and a second valve element 420 in the form of an annular disc which is carried on a second end of the valve actuator 390. The second valve element 420 may be slidably received on an outer cylindrical surface of the valve actuator 390, proximate to its second end. The second valve element 420 is biased toward the second end of the valve actuator 390 by a first spring member 422, in the form of a coil spring, which surrounds the outer cylindrical surface of the valve actuator 390, and has an opposite end which abuts against an annular shoulder of the valve actuator 390.

The valve mechanism 386 further comprises first and second valve seats. The first valve seat 412 is defined above, and comprises the flat, planar, annular end face of annular end portion 404 of spool member 402. The first valve seat 412 seals with the first valve element 418 under cold flow conditions. The second valve seat 122 is defined above as the annular shoulder separating the second and third valve chambers 116, 118. The second valve seat 122 seals with the second valve element 420 under hot flow conditions.

As further discussed below, the valve mechanism 386 is operable to move the first valve element 418 longitudinally between a position in which it sealingly engages the first valve seat 412, and a position in which it is spaced from the first valve seat 412. The valve mechanism 386 is also operable to move the second valve element 420 longitudinally between a position in which it sealingly engages the second valve seat 122 and a position in which it is spaced from the second valve seat 122.

The first spring member 422 acts as an override spring which opposes longitudinal motion of the second valve element 420 away from the second valve seat 122. A second spring member 428 in the form of a coil spring extends longitudinally from the second end of the valve actuator 390 and into the second valve chamber 116. The second spring member 428 acts as a return spring which opposes longitudinal motion of the second valve element 420 toward the second valve seat 122 (acting as a counter-spring relative to first spring member 422), and which also opposes longitudinal motion of the first valve element 418 away from the first valve seat 412.

FIG. 4 shows the valve mechanism 386 with the piston 394 of actuator 390 in the retracted state. This defines the "cold" state of valve mechanism 386, wherein the oil flowing through the valve bore 112 in contact with actuator 390 is relatively cold, and the wax material inside actuator 390 is in a contracted state. Such a cold state exists, for example, during cold starting of the vehicle. During the cold state, engine coolant is heated by circulation through the vehicle's internal combustion engine, and a portion of the heated coolant is circulated through the second fluid flow passages 26 of the TOH 12, where it transfers heat to the oil flowing through the first fluid flow passages 24.

In the cold state, the oil entering valve assembly 16 through second oil port 88 will preferentially flow into the first fluid flow passages 24 of the first heat exchanger 12 (TOH), because the valve mechanism 386 effectively provides fluid communication between the first heat exchanger 12 and one of the first and second oil ports 86, 88 through one or more of the chambers 114, 116, 118 comprising the valve bore 112, while blocking fluid communication between the second heat exchanger 14 and one of the first and second oil ports 86, 88 through one or more of the chambers 114, 116, 118 comprising the valve bore 112.

In the cold state, the first valve element 418 is in sealed engagement with the first valve seat 412 of spool member 402, thereby preventing fluid communication between the first and third valve chambers 114, 118, and preventing fluid communication between the fifth oil port 94 and the first oil port 86 through the first valve chamber 114. Therefore, in the cold state, oil flow between the second heat exchanger 14 (TOC) and the first oil port 86 through first valve opening 410 is prevented by the blocking of the first valve opening 410 by the first valve element 418.

Also in the cold state, the second valve element 420 is longitudinally spaced apart from the second valve seat 122, wherein this spacing defines a second valve opening 430. Fluid communication is therefore permitted between the second and third valve chambers 116, 118, thereby allowing fluid communication between the third oil port 90 and the first oil port 86 through the second valve chamber 116. Therefore, oil flow between the first heat exchanger (TOH) and the first oil port 86 is permitted through the second valve opening 430.

As the temperature of the oil flowing through valve bore 112 increases, it causes the wax material 390 inside actuator to become heated and expand. The expansion of the wax material causes extension of the piston 394. The extension of piston 394 causes longitudinal displacement of the body of actuator 390, along with the associated first and second valve elements 418, 420. This defines the "hot" state of valve mechanism 386, shown in FIG. 5B, wherein the oil flowing through the valve bore 112 in contact with actuator 390 is relatively warm, and the wax material inside actuator 390 is in an expanded state. Such a hot state exists, for example, during normal operation of the vehicle.

In the hot state, the oil entering valve assembly 16 through second oil port 88 will preferentially flow into the first fluid flow passages 24 of second heat exchanger 14 (TOC). In this state, valve mechanism 386 effectively provides fluid communication between the second heat exchanger 14 and one of the first and second oil ports 86, 88 through one or more of the chambers 114, 116, 118 comprising the valve bore 112. The valve mechanism also blocks fluid communication between the first heat exchanger 12 and one of the first and second oil ports 86, 88 through one or more of the chambers 114, 116, 118 comprising the valve bore 112.

More specifically, the actuator 390 is displaced by a sufficient distance that the first valve element 418 is longitudinally spaced from the first valve seat 412, to permit fluid communication between the first and third valve chambers 114, 118 through first valve opening 410 and allowing fluid communication between the fifth oil port 94 and the first oil port 86 through the first valve chamber 114. Therefore, oil flow between the second heat exchanger 14 (TOC) and the first oil port 86 through first valve opening 410 is permitted by the opening of the first valve opening 410. In the hot state, a stream of relatively cool engine coolant is circulated through the second fluid flow passages 26 of TOC 14, where it absorbs heat from the oil flowing through the first fluid passages 24.

Also in the hot state, the second valve element 420 is in sealed engagement with the second valve seat 122, to prevent fluid communication between the second and third valve chambers 116, 118 through second valve opening 430, and preventing fluid communication between the third oil port 90 and the first oil port 86 through the second valve chamber 116. Therefore, oil flow between the first heat exchanger (TOH) 12 and the first oil port 86 is prevented by the blocking of the second valve opening 430.

As mentioned above, the second valve element 420 is slidably and resiliently mounted on the actuator 390, between the first and second spring members 422, 428. The rating of the first (override) spring member 422 can be selected to provide the valve assembly 16 with a hot pressure bypass function. In the hot state, hot transmission oil flows through the second heat exchanger 14 (TOC). A spike in the oil pressure in the hot state can cause damage to the second heat exchanger 14, and therefore the pressure rating of the first spring member 422 can be selected such that the second valve element 420 will be forced out of contact with the second valve seat 122, against the force of the first spring member 422, when the oil pressure in the TOC rises above a selected pressure threshold. For example, in some embodiments, the pressure threshold could be about 30 psi.

During the high pressure condition, the volume of oil flow through the second heat exchanger 14 will be reduced, with at least a portion of the oil being diverted through the first heat exchanger 12, which may have a higher pressure rating than the second heat exchanger 14. Once the oil pressure returns to a level below the threshold, the first spring member 422 will force the second valve element 420 into engagement with second valve seat 122 to once again cause the hot oil to flow through the second heat exchanger 14.

The heat exchanger assembly 10 may include additional elements to provide a pressure bypass, whereby at least a portion of the oil will bypass the first fluid flow passages 24 of both the first and second heat exchangers 12, 14 under certain vehicle operating conditions where high oil pressure may develop. For example, cold transmission oil is relatively viscous and, when the cold oil is passed through the first heat exchanger 12 (TOH) with the valve assembly 16 in the cold state, a high pressure drop may develop between the oil inlet and outlet manifolds 42, 44 of the first heat exchanger 12. Also, as explained above, spikes in the oil pressure may develop with the valve assembly 16 in the hot state, causing high oil pressure in the second heat exchanger 14 (TOC). The heat exchanger assembly 10 may therefore include a high pressure bypass which permits at least a portion of the oil to bypass the first fluid flow passages 24 of both heat exchangers 12, 14 during high pressure conditions which may develop with the valve assembly 16 in the cold or hot state.

Figure 5D:
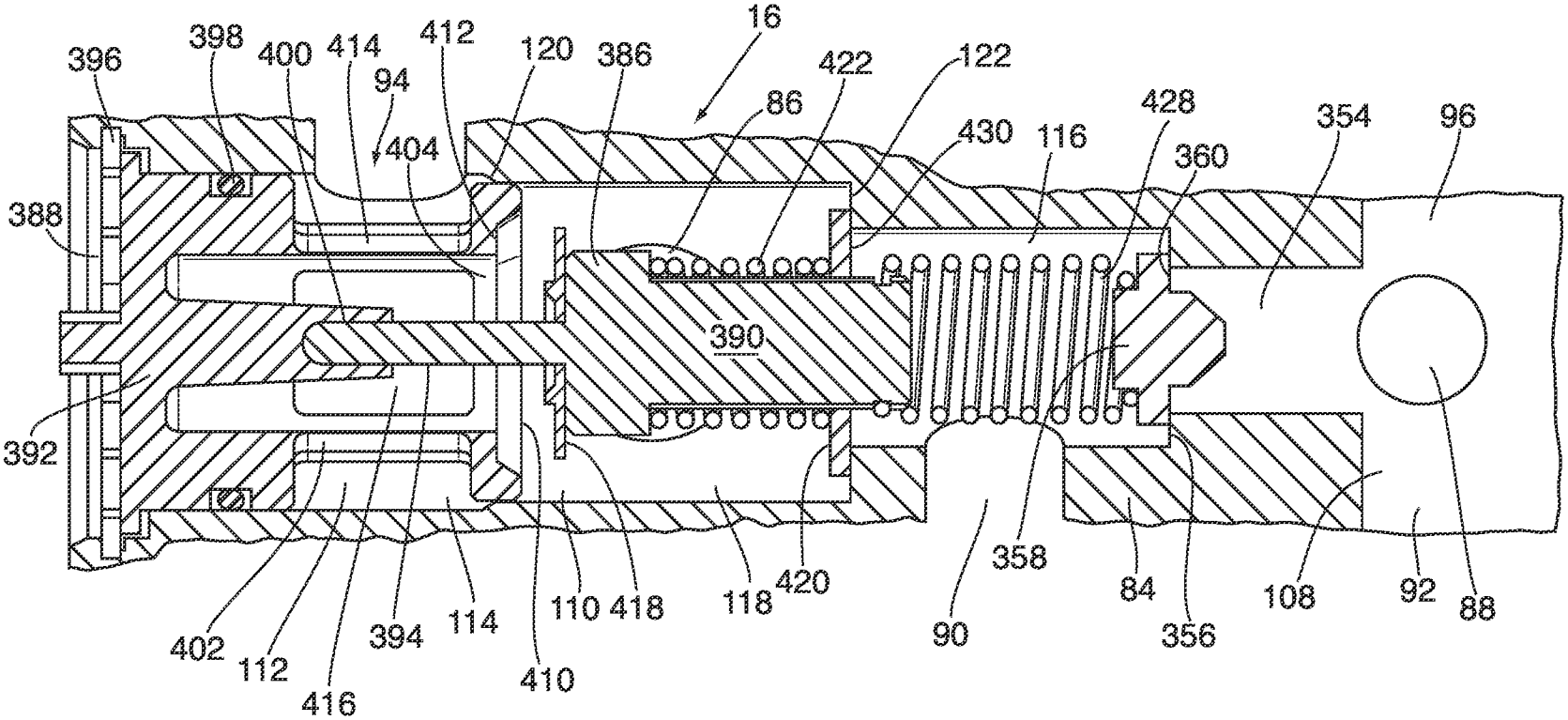
FIG. 5D is a close-up cross sectional view, similar to FIG. 5B, showing a variant of the heat exchanger assembly of FIG. 1 including a high pressure bypass.

For example, FIG. 5D shows a variant of heat exchanger assembly 10 in which the assembly 10 further comprises a bypass flow passage 354 extending longitudinally between, and in fluid communication with, the first interior space 108 and the second interior space 110. In the present example, the bypass flow passage 354 may comprise a longitudinally-extending extension of the valve bore 112. The bypass flow passage 354 has a smaller diameter than the second valve chamber 116, such that a third annular shoulder 356 is formed between the second valve chamber 116 and the bypass flow passage 354.

The heat exchanger assembly of FIG. 5D further comprises a pressure-actuated valve element 358 (also referred to herein as the "third valve element") which is adapted to selectively block or allow flow of the first fluid (oil) through the bypass flow passage 354 from the first interior space 108 to the second interior space 110. In the illustrated arrangement, one end of second spring member 428 (the return spring), opposite to the end which is secured to actuator 390, is secured to the third valve element 358, which is in the form of a valve plug. The third valve element 358 has an annular sealing surface 360 which is adapted to sealingly engage the third annular shoulder 356 (also referred to herein as "third valve seat") to block the bypass flow passage 354 as shown in FIG. 5D where the oil pressure does not exceed a predetermined threshold level. FIG. 5D shows the valve assembly 16 in the hot state, however, the second spring member 428 will also maintain engagement between the third valve element 358 and third annular shoulder 356 in the cold state, for example as described and shown in commonly assigned U.S. patent application Ser. No. 16/189,166, which is incorporated herein in its entirety.

Where the second oil port 88 is the oil inlet port and the first oil port 86 is the oil outlet port, a sufficiently high predetermined pressure differential (or pressure drop) between the first interior space 108 and the second interior space 110 will actuate the bypass valve element 358, causing it to move out of engagement with the third valve seat 356 and permit the oil to flow from the first interior space 108 to the second interior space 110. As can be seen from FIG. 5D, with the valve assembly 16 in the hot state, the oil pressure must be sufficiently high to displace both the second and third valve elements 420, 358 from their respective valve seats 122, 356, to enable at least a portion of the hot oil to flow directly from the second oil port 88 (inlet) to the first oil port 86 (outlet), bypassing both heat exchangers 12, 14.

With the valve assembly 16 of FIG. 5D in the cold state, the second valve element 420 is spaced from second valve seat 122 (as shown in FIG. 4), such that the oil pressure needs only displace the third valve element 358 from third valve seat 356 to enable at least a portion of the cold oil to flow directly from the second oil port 88 to the first oil port 86, thereby bypassing both heat exchangers 12, 14.

Although FIG. 5D illustrates a specific high pressure bypass arrangement, it will be appreciated that an alternate form of high pressure bypass may instead be incorporated into heat exchanger assembly 10. For example, the valve assembly 16 may include a pressure relief valve including a separate spring and valve element inside the bypass flow passage 354, rather than having the third valve element 358 connected to the return spring 428. Alternatively, one or both of the heat exchangers 12, 14 may be provided with a pressure bypass valve assembly as disclosed in commonly assigned U.S. patent application Ser. No. 16,839,061, which is incorporated herein by reference in its entirety. Incorporating such a pressure bypass valve assembly into either the first or second heat exchanger 12, 14 will permit cold or hot oil to flow directly between the oil manifolds 42, 44 without passing through the first fluid flow passages 24 in the event of a high pressure condition.

Figure 15:
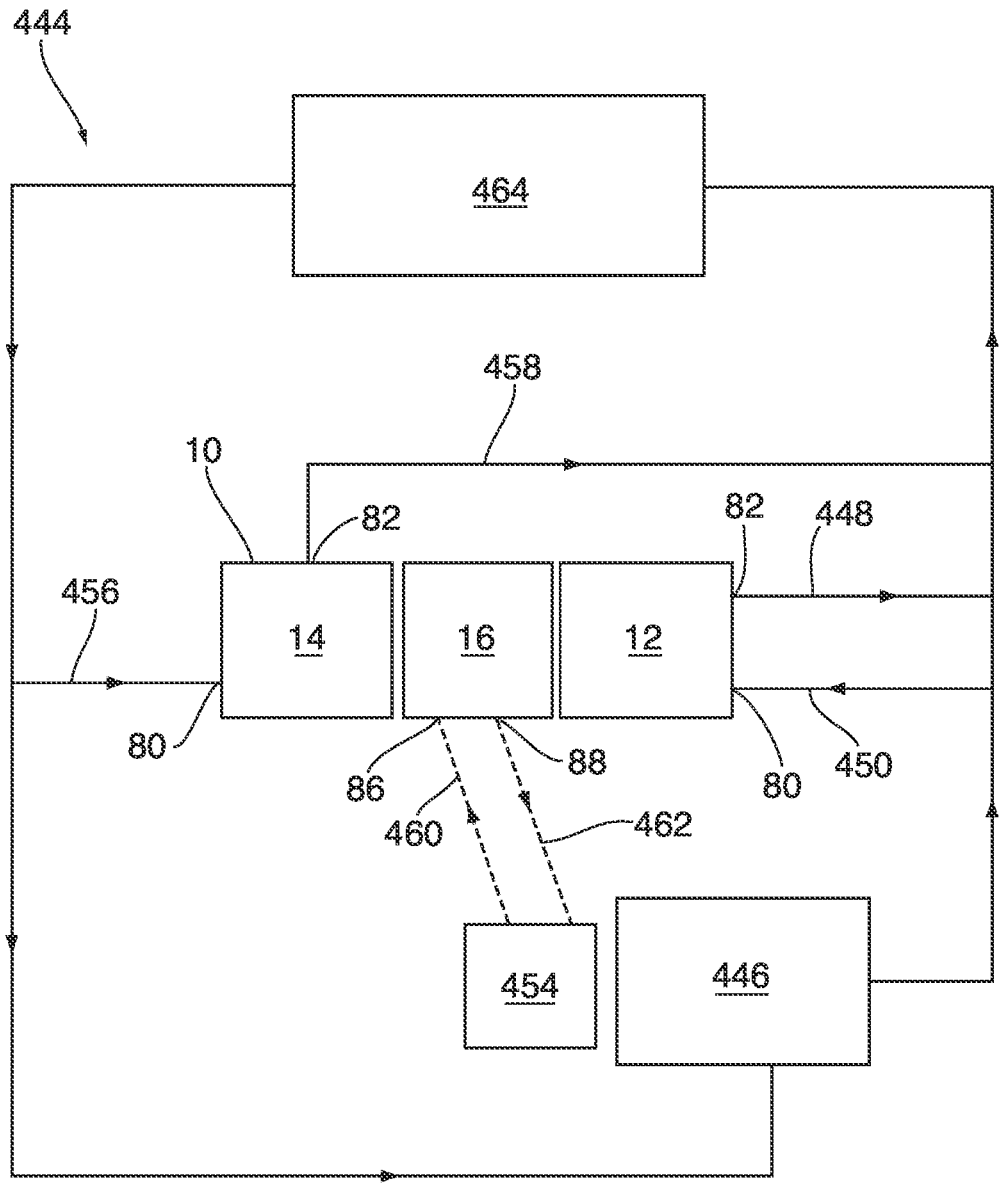
FIG. 15 is a schematic view of a fluid circulation system for a motor vehicle.

FIG. 15 schematically shows the heat exchanger assembly 10 incorporated into a fluid circulation system 444 of a motor vehicle. The fluid circulation system 444 includes a coolant circulation loop which includes an internal combustion engine 446, a radiator 464, and the first and second heat exchangers 80, 82. The fluid circulation system 444 also includes a transmission oil circulation loop including a transmission 454 and the valve assembly 16. The conduits of the coolant circulation loop are shown in solid lines and the conduits of the transmission oil circulation loop are shown in dashed lines, with arrows show the flow direction in each loop. The system 444 uses engine coolant to alternately heat and cool the transmission oil circulating within system 444, with the heat exchanger assembly 10 controlling whether the oil is heated or cooled.

Coolant conduits 448, 450 connect the first heat exchanger 12 (TOH) to the coolant circulation loops, with the coolant conduit 450 receiving heated coolant directly from a coolant outlet of the engine 446, or immediately downstream of engine 446, and transferring it to the TOH 12 through coolant inlet fitting 80. After transferring heat to the oil in first heat exchanger 12, the coolant is discharged from coolant outlet fitting 82 into coolant conduit 448, and flows toward radiator 464.

The coolant circulation loop also includes coolant conduits 456, 458 connecting the second heat exchanger 14 (TOC) to the coolant circulation system, with the coolant conduit 456 receiving cooled coolant directly from a radiator 464, or immediately downstream of a radiator 464, and transferring it to the coolant inlet fitting 80 of TOC 14. After removing heat from the oil in second heat exchanger 14, the coolant is discharged from coolant outlet fitting 82 into coolant conduit 448, and flows toward radiator 464.

The coolant may be continuously circulated through the TOC 14 and the TOH 12 regardless of the operational state of valve assembly 16.

In the present embodiment, a number of the metal components of heat exchanger assembly 10 (i.e. excluding the thermal valve mechanism 386) may be comprised of aluminum (including alloys thereof) and are joined together by brazing. For example, these metal components may be assembled and then heated to a brazing temperature in a brazing oven, whereby the metal components are brazed together in a single brazing operation, as is known in the art, to form a brazed sub-assembly. Following the brazing operation, the thermal valve mechanism 386 is then assembled to the brazed sub-assembly.

In some cases, the height of the heat exchanger assembly 10 may make it difficult to maintain all the metal components within a desired brazing temperature range inside the brazing oven. Where this is an issue, one or both of the heat exchangers 12, 14 can be assembled in a separate brazing operation, and can then be mechanically secured to one of the surfaces of the thermal valve assembly 16.

For example, in the heat exchanger assembly 10 according to the first embodiment, the metal components of the second heat exchanger 14 and the thermal valve assembly 16 (excluding valve mechanism 386) are brazed together in a single brazing operation to provide a unitary, one-piece first sub-assembly 142 comprising the metal components of second heat exchanger 14 and thermal valve assembly 16, and excluding the valve mechanism 386.

During this brazing operation, the bottom plate 52 of the second heat exchanger 14 is sealingly joined to the second surface 104 of the valve housing 84, for example by brazing. The bottom plate 52 may be brazed to the second surface 104 either directly or through a shim plate 70 having a pair of openings 72, 74 which are aligned with the conduit openings 58, 60 of bottom plate 52. Since the external ends of the fifth and sixth oil ports 94, 96 may be somewhat offset from the conduit openings 58, 60 of bottom plate, the second surface 104 of the valve housing 84 may be provided with transfer channels 124, 126, to provide fluid communication between oil ports 94, 96 and respective conduit openings 58, 60. The transfer channels 124, 126 can be formed in second surface 104 by machining. In some embodiments the transfer channels may be provided in a separate adapter plate which is interposed between the bottom plate 52 and the second surface 104, however, this increases the number of components.

The metal components of first heat exchanger 12 are sealingly joined together in a separate brazing operation. Both the first heat exchanger 12 and the valve assembly 16 include features which permit the mechanical fastening of the first heat exchanger 12 to the first surface 102 of the valve housing 84. These features are now described below.

The first heat exchanger 12 includes a bottom plate 52 and optionally includes a shim plate 70, both of which are as described above. In addition, the bottom of first heat exchanger 12 may be provided with an adapter plate 146 which has a first surface 148 and an opposite second surface 150. The first surface 148 of adapter plate 146 is sealingly joined to the bottom plate 52 or the optional shim plate 70 and forms part of the second sub-assembly 144. The adapter plate 146 is therefore joined to the first heat exchanger 12 during the same brazing operation in which the first heat exchanger 12 is assembled.

The adapter plate 146 includes a pair of openings 152, 154 to provide fluid communication between the third and fourth oil ports 90, 92 of the valve assembly 16 and the conduit openings 58, 60 of the bottom plate 52. Because the external ends of the third and fourth oil ports 90, 92 may be somewhat offset from the conduit openings 58, 60, the adapter plate 146 may be provided with transfer channels 156, 158 to provide fluid communication between the third and fourth oil ports 90, 92 and the conduit openings 58, 60. In the present embodiment the adapter plate 146 is in the form of a shaped plate, formed by stamping or drawing, and transfer channels 156, 158 comprise troughs which protrude in a downward direction, i.e. away from the bottom plate 52 of the first heat exchanger 12, and extend parallel to the bottom plate 52 between the one of the third and fourth oil ports 90, 92 and its associated conduit opening 58, 60. The openings 152, 154 in the adapter plate 146 are each formed at one end of a respective one of the transfer channels 156, 158, and are aligned with the respective third and fourth oil ports 90, 92. Although the adapter plate 146 is in the form of a shaped plate in the present embodiment, this is not essential. Rather, the adapter plate 146 may instead comprise a thicker, flat plate in which the transfer channels 156, 158 comprise grooves or channels extending partially or completely through the thickness of the adapter plate 146. Also, it is not essential that the adapter plate 146 has upturned peripheral edges.

The second surface 150 of adapter plate 146 is mechanically sealed to the first surface 102 of valve assembly 16, for example by a plurality of threaded fasteners 160, such as bolts or screws. In the present embodiment, the peripheral edge of adapter plate 146 extends outwardly of the periphery of the core 22 of first heat exchanger 12 and is provided with a plurality of apertures 162 which align with threaded bores 164 in the valve body 84. A resilient sealing element 166 such as an O-ring surrounds each aligned pair of oil ports 90, 92 and openings 152, 154 to prevent fluid leakage between the adapter plate 146 and second surface 102 of valve assembly 16. Each O-ring 166 may be received inside a circular groove 168 in the first surface 102 of valve assembly 16.

In the present embodiment the troughs comprising the transfer channels 156, 158 of adapter plate 146 may be spaced below the plane in which the apertures 162 are located. Accordingly, the portion 170 of first surface 102 of valve assembly 16 containing oil ports 90, 92 may be recessed below the peripheral edges thereof, in which the threaded bores 164 are provided. The recessed portion 170 receives the transfer channels 156, 158 and, in the present embodiment, comprises a wide, longitudinally extending groove 170.

Figure 6:
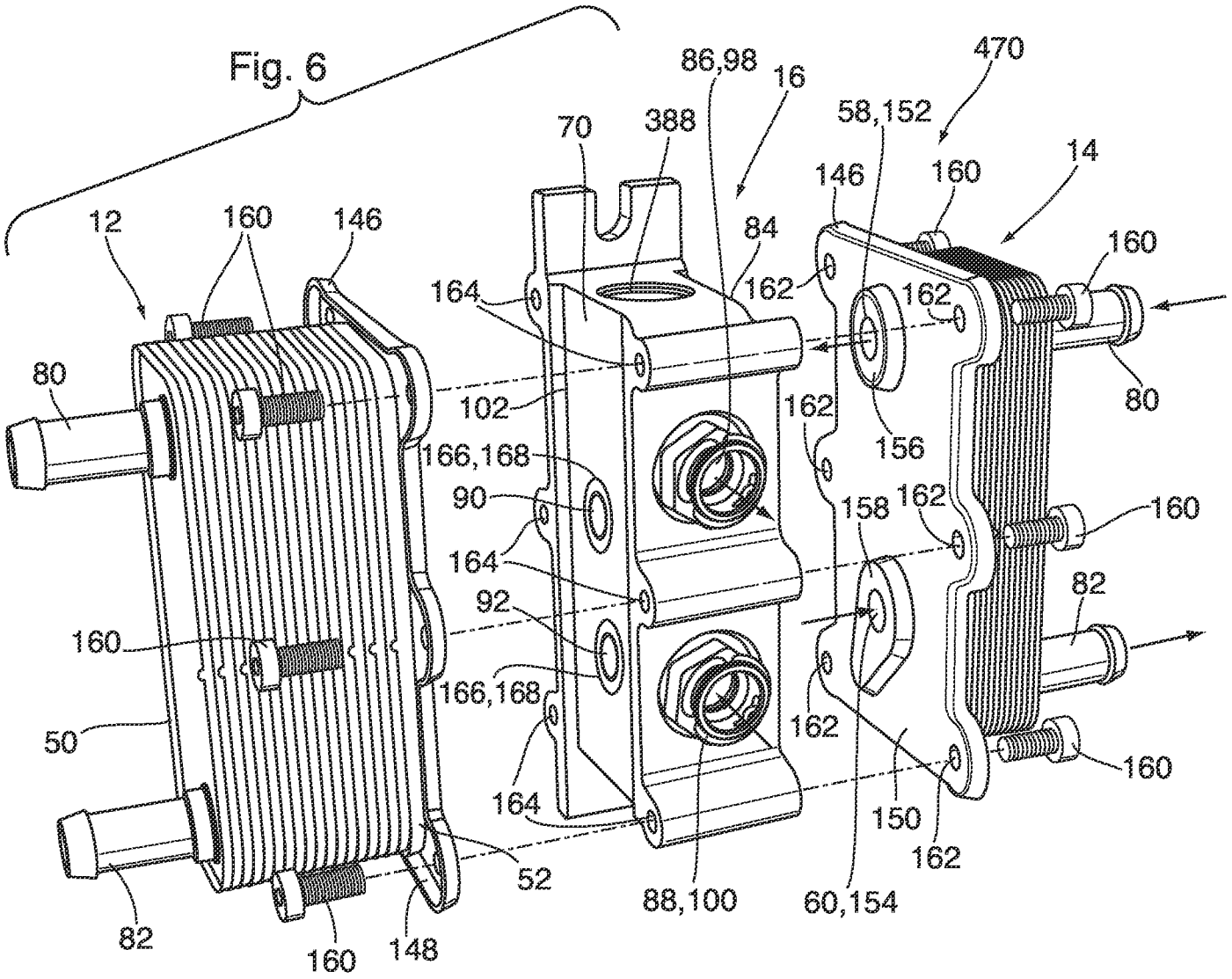
FIG. 6 is a partly disassembled perspective view from a first end of a heat exchanger assembly according to a second embodiment.
Figure 7:
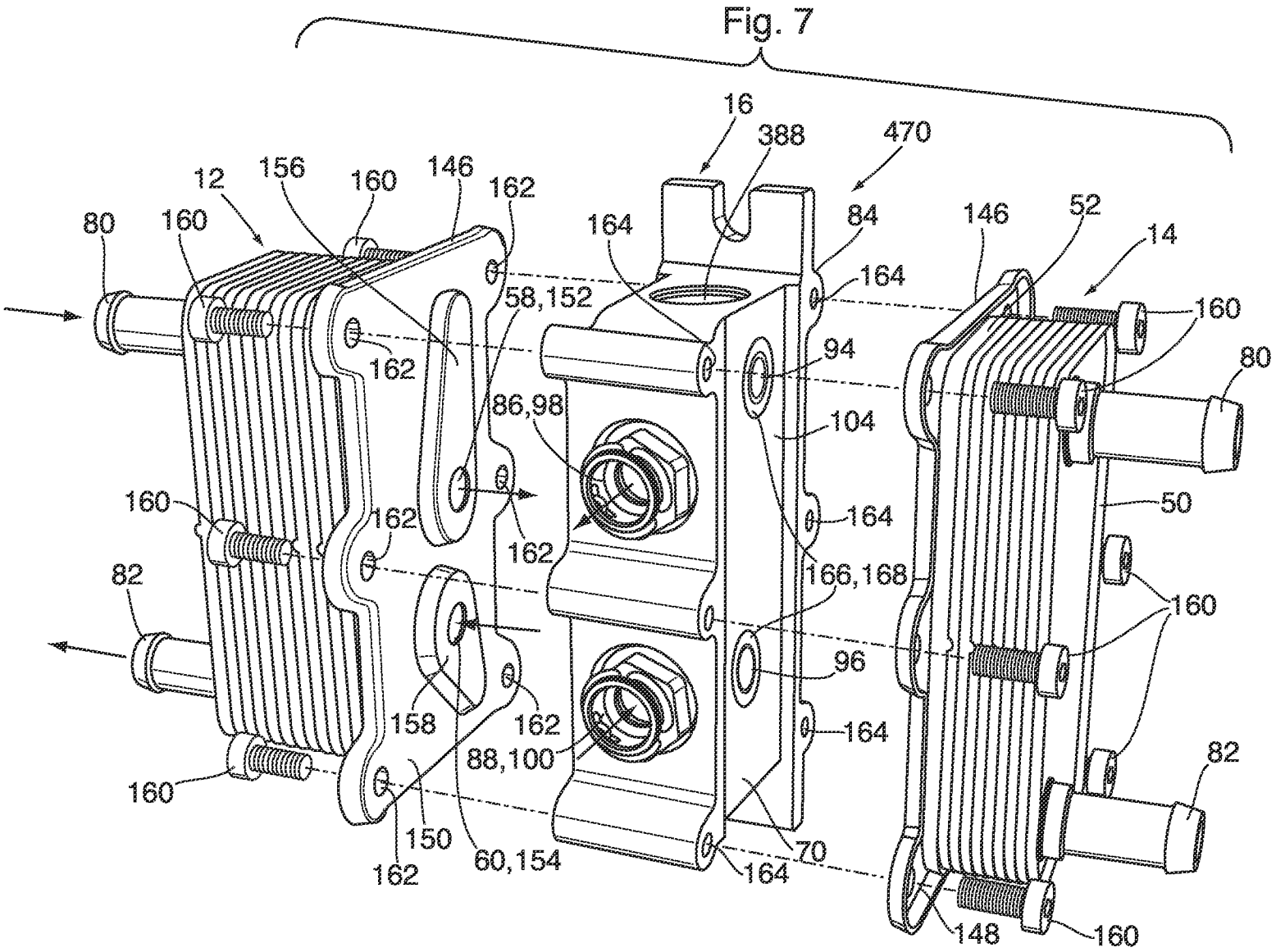
FIG. 7 is a partly disassembled perspective view from a second end of the heat exchanger assembly according to the heat exchanger assembly of FIG. 6.

A heat exchanger assembly 470 according to a second embodiment is now described with reference to FIGS. 6 and 7. Heat exchanger assembly 470 is similar in structure to heat exchanger assembly 10 described above, and includes many of the same components, which are identified herein with the same reference numerals. The above description of these like-numbered components of heat exchanger assembly 10 applies equally to assembly 470.

The first and second heat exchangers 12, 14 of heat exchanger assembly 470 are sealingly joined to opposed first and second surfaces 102, 104 of valve assembly 16, and are therefore arranged at about 180 degrees to one another. However, the angle between first and second surfaces may be more or less than 180 degrees, depending on the specific application. As with heat exchanger assembly 10, the first heat exchanger 12 (TOH) of heat exchanger assembly 470 is mechanically secured to the first surface 102 of valve assembly 16. However, rather than being brazed to the second surface 104 of valve assembly 16, the second heat exchanger 14 of assembly 470 is also mechanically secured to the valve assembly 16. To allow for mechanical securement of both heat exchangers 12, 14, the threaded bores 164 of valve housing 84 may be double-ended to receive threaded fasteners 160 from both ends, or a separate set of threaded bores 164 may be provided to secure the second heat exchanger 14. In addition, the second heat exchanger 14 may be provided with the same or similar connection means as the first heat exchanger 12, comprising an adapter plate 146, the first surface 148 of which is brazed to the bottom plate 52 of heat exchanger 14, either directly or through an optional shim plate 70 (not shown in FIGS. 6 and 7). In the present embodiment, one of the openings 58, 60 in the base plate 52 of the second heat exchanger 14 is aligned with the corresponding fifth or sixth port 94, 96 of the valve assembly 16, and therefore the transfer channel 156 or 158 is in the form of circular boss. In the present embodiment, the first and second surfaces 102, 104 of valve assembly 16 may both be provided with resilient sealing elements 166, circular grooves 168 and a longitudinal groove 170, all as described above.

Figure 8:
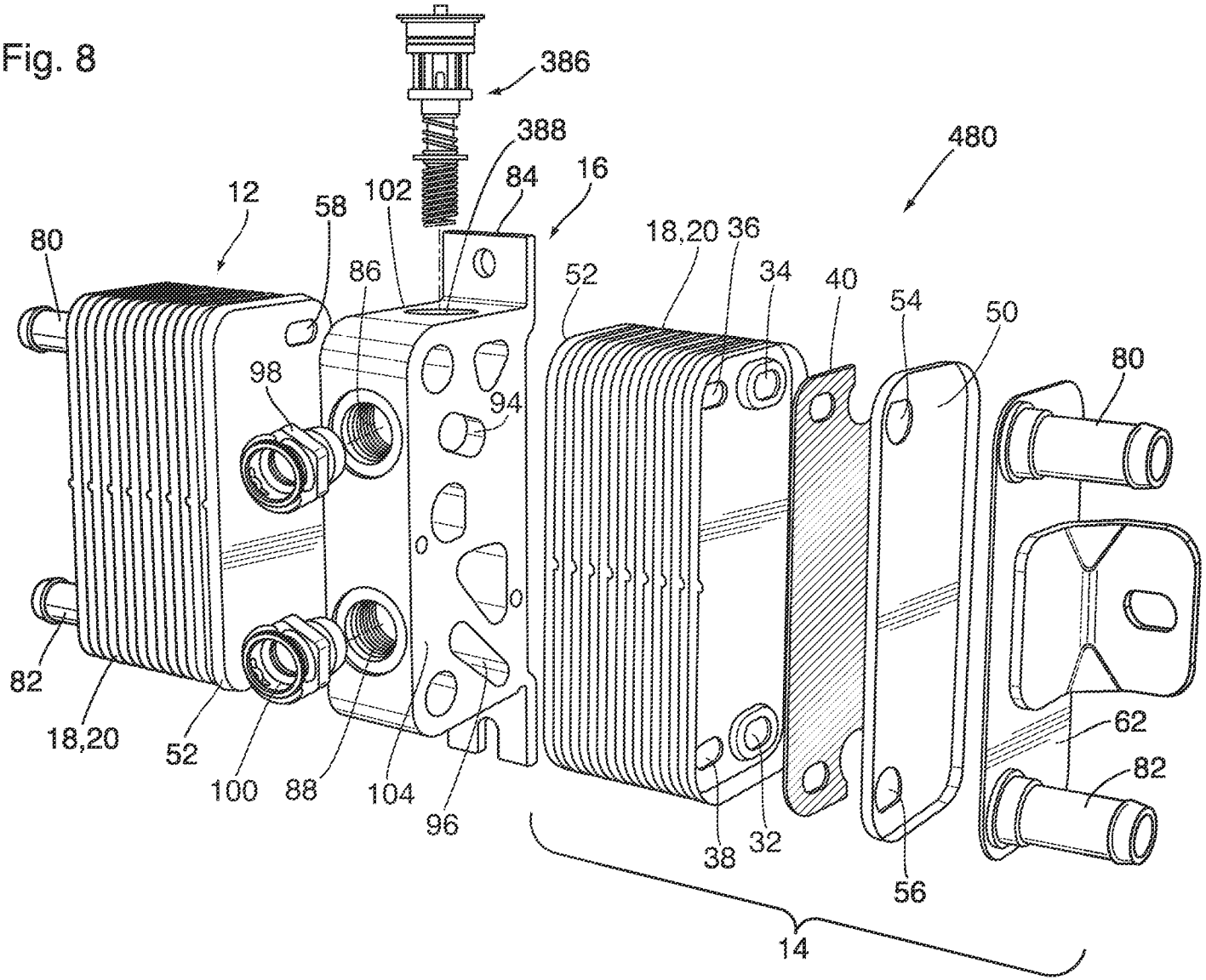
FIG. 8 is a partly disassembled perspective view from a first end of a heat exchanger assembly according to a third embodiment.

A heat exchanger assembly 480 according to a third embodiment is now described with reference to FIG. 8. Heat exchanger assembly 480 is similar in structure to heat exchanger assembly 10 described above, and includes many of the same components, which are identified herein with the same reference numerals. The above description of these like-numbered components of heat exchanger assembly 10 applies equally to assembly 480.

The first and second heat exchangers 12, 14 of heat exchanger assembly 480 are sealingly joined to opposed first and second surfaces 102, 104 of valve assembly 16, and are therefore arranged at about 180 degrees to one another. However, the angle between first and second surfaces may be more or less than 180 degrees, depending on the specific application. As with heat exchanger assembly 10, the second heat exchanger 14 (TOC) of heat exchanger assembly 480 is brazed to the second surface 104 of valve assembly 16. However, rather than being mechanically joined to the first surface 102 of valve assembly 16, the first heat exchanger 12 of assembly 480 is also brazed to the valve assembly 16. According to this embodiment, both heat exchangers 12, 14 are simultaneously joined together and sealingly joined to the opposed first and second surfaces 102, 104 of valve assembly 16 in a single brazing operation.

It can be seen that the heat exchanger assembly 480 has a simpler construction than that of assemblies 10 and 470 described above, in that no adapter plate(s) 146 is required to join either of the heat exchangers 12, 14 to the valve assembly 16. Instead, the bottom plates 52 of both heat exchangers 12, 14 are brazed to the first and second surfaces 102, 104, either directly or through a shim plate 70 (not shown) as described above.

Figure 9:
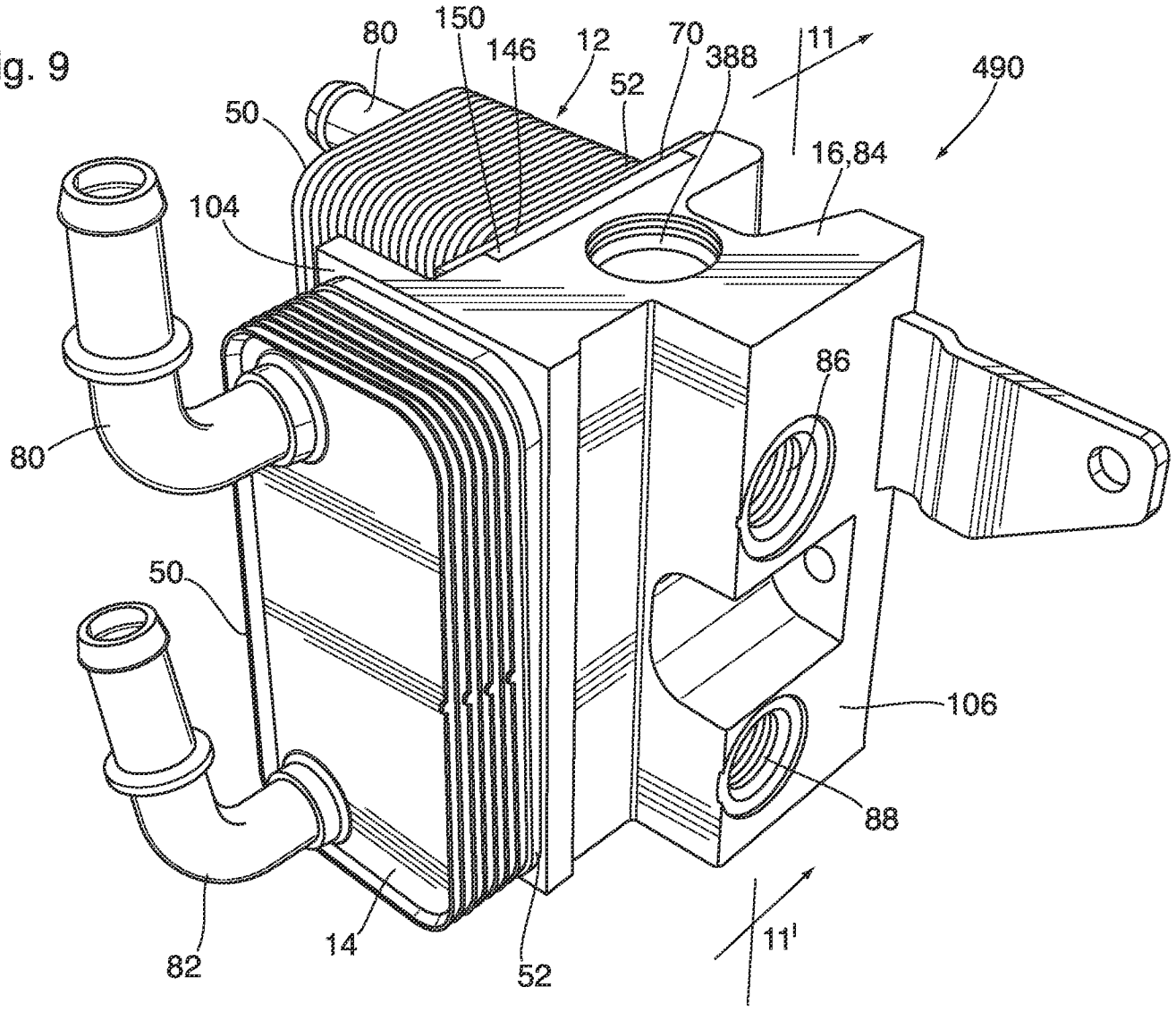
FIG. 9 is a perspective view from a first side of a heat exchanger assembly according to a fourth embodiment.
Figure 10:
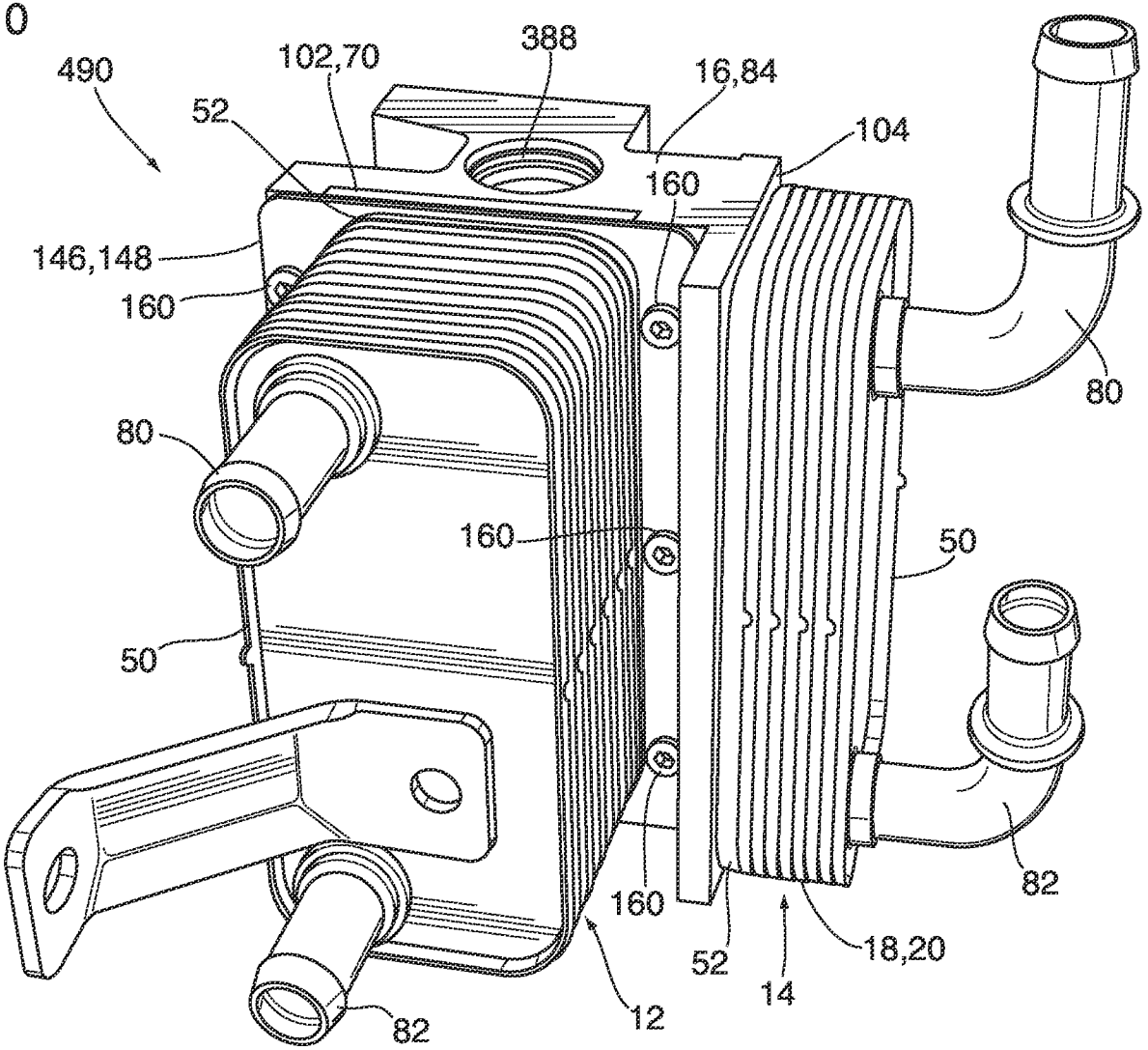
FIG. 10 is a perspective view from a second side of the heat exchanger assembly of FIG. 9.
Figure 11:
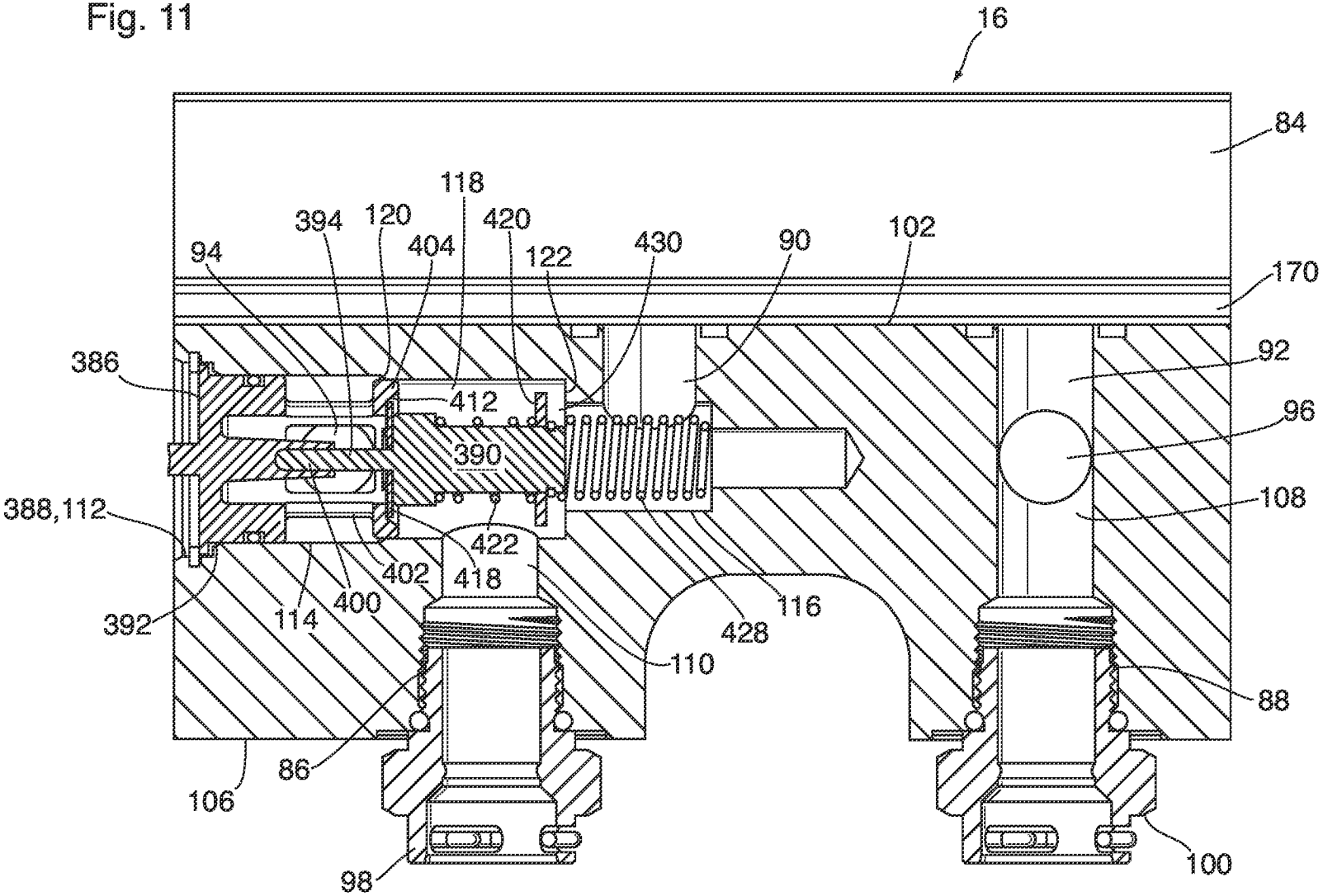
FIG. 11 is a cross-section along line 11-11' of FIG. 9, showing the valve assembly in isolation.

A heat exchanger assembly 490 according to a fourth embodiment is now described with reference to FIGS. 9 to 11. Heat exchanger assembly 490 is similar in structure to heat exchanger assembly 10 described above, and includes many of the same components, which are identified herein with the same reference numerals. The above description of these like-numbered components of heat exchanger assembly 10 applies equally to assembly 490.

In the present embodiment, the first and second surfaces 102, 104 of valve assembly 16 are arranged at about 90 degrees to one another, and heat exchangers 12, 14 are also arranged at 90 degrees to one another. However, the angle between first and second surfaces 102, 104 and between the first and second heat exchangers 12, 14 may be more or less than 90 degrees, depending on the specific application. As with heat exchanger assembly 10, the first heat exchanger 12 (TOH) of heat exchanger assembly 470 is mechanically secured to the first surface 102 of valve assembly 16, and the second heat exchanger 14 (TOC) is brazed to the second surface 104 of valve assembly 16. In addition, the third surface 106, on which the external ends of the first and second oil ports 86, 88 are provided, is arranged at about 180 degrees to one of the first and second surfaces 102, 104, and at about 180 degrees to one of the heat exchangers 12, 14, in this case the first heat exchanger 12. However, it is not required that oil ports 86, 88 are located in the same surface 106, or that this surface is arranged at 180 degrees to one of the first and second surfaces 102, 104, or at 180 degrees to one of the heat exchangers 12, 14. Rather, the surface 106 can be oriented at more or less than 180 degrees to each of the surfaces 102, 104.

The arrangement of heat exchanger assembly 490 can be understood as a variant of assembly 10 where the locations of the second and third surfaces 104, 106 are interchanged. The internal fluid routing inside valve assembly 16, as well as the structure and function of valve mechanism 386 (shown only in FIG. 11), is essentially the same as that of heat exchanger assembly 10.

Although heat exchanger assembly 490 includes one brazed heat exchanger 14 and one mechanically connected heat exchanger 12, it will be appreciated that variants of heat exchanger assembly 490 could be constructed in which both heat exchangers 12, 14 are mechanically connected to the valve assembly 16 (as in assembly 470), or in which both heat exchangers 12, 14 are brazed to the valve assembly 16 (as in assembly 480).

Figure 12:
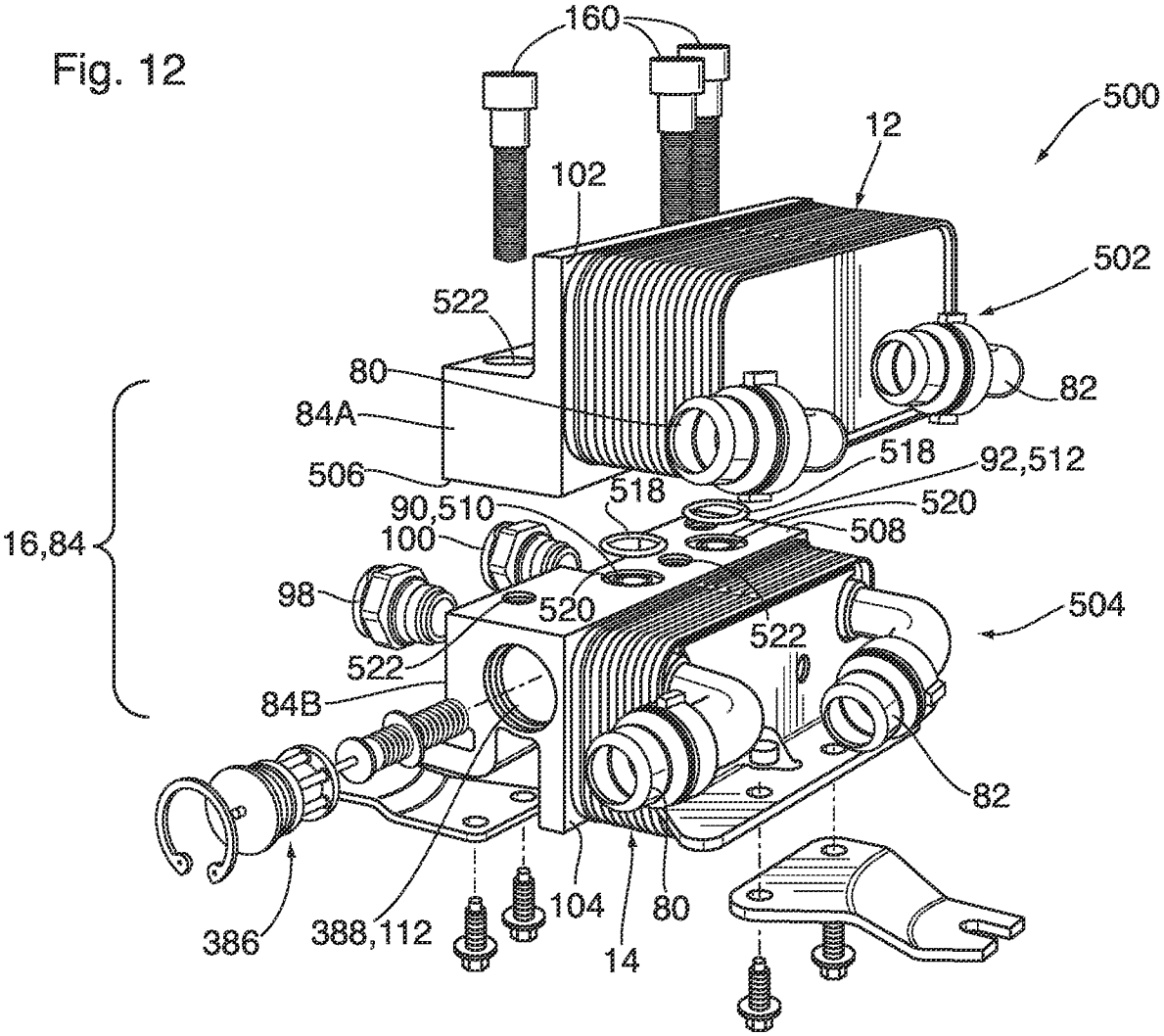
FIG. 12 is a perspective view from a first side of a heat exchanger assembly according to a fifth embodiment of the present disclosure.
Figure 13:
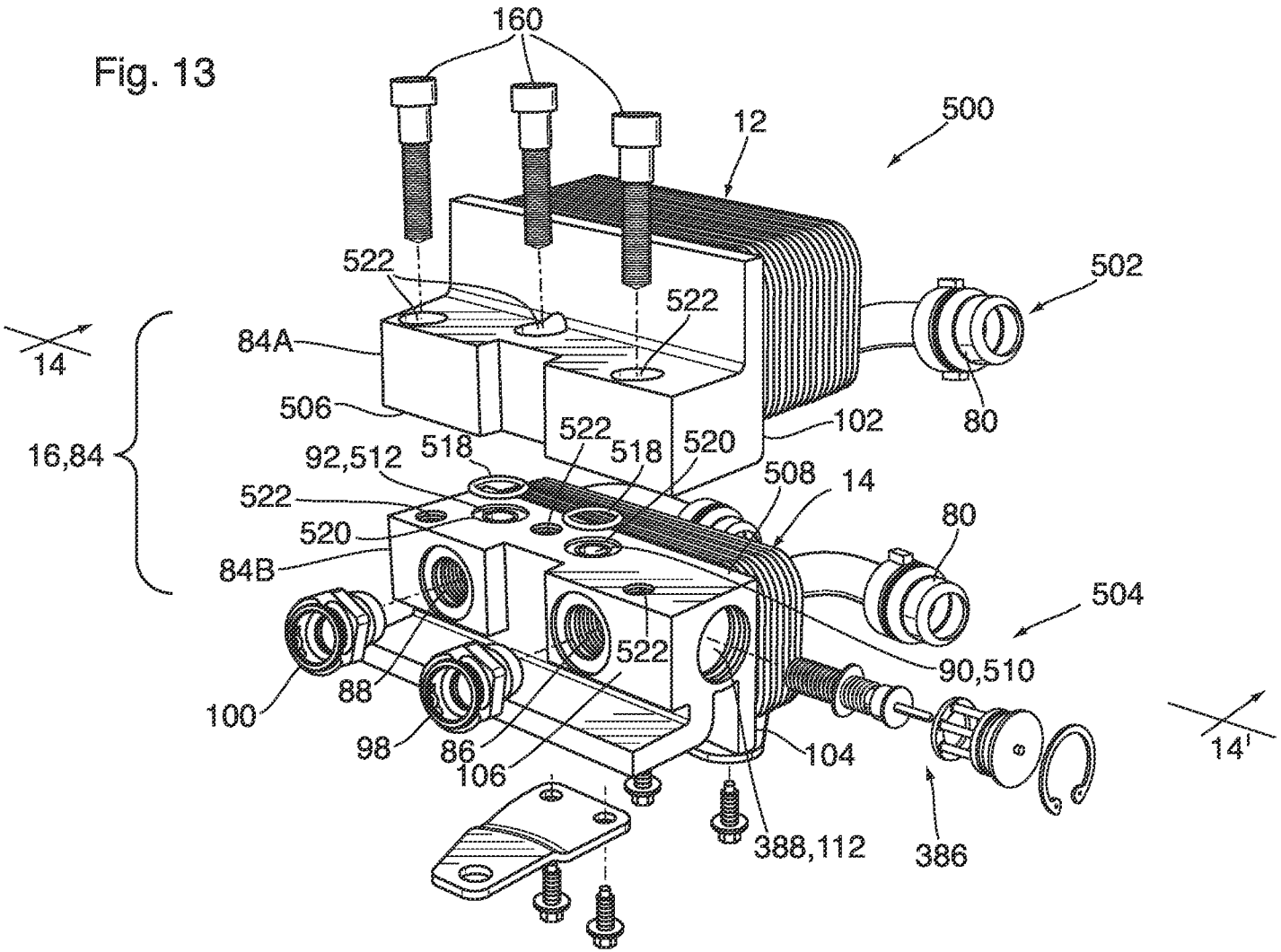
FIG. 13 is a perspective view from a second side of the heat exchanger assembly of FIG. 12.

A heat exchanger assembly 500 according to a fifth embodiment is now described with reference to FIGS. 12 to 14. Heat exchanger assembly 500 is similar in structure to heat exchanger assembly 10 described above, and includes many of the same components, which are identified herein with the same reference numerals. The above description of these like-numbered components of heat exchanger assembly 10 applies equally to assembly 500.

Broadly speaking, the heat exchanger assembly 500 takes a different approach at avoiding the need to simultaneously braze two heat exchangers 12, 14 to a valve assembly 16. In the present embodiment, the valve housing 84 comprises first and second valve housing segments 84A, 84B, wherein the first surface 102 is provided in first segment 84A and the second surface 104 is provided in second segment 84B. During assembly, the first heat exchanger 12 is brazed to the first surface 102 in segment 84A to provide a first subassembly 502, and the second heat exchanger 14 is brazed to the second surface 104 in segment 84B to provide a second subassembly 504. The two brazed subassemblies 502, 504 are then combined into assembly 500 by mechanically securing together the two segments 84A, 84B of valve housing 84. The first and second segments 84A, 84B have respective first and second connection surfaces 506, 508 along which they are joined together.

The valve mechanism 386 is housed in one of the segments of housing 84. In the present embodiment, valve mechanism 386 is housed in second segment 84B to which the second heat exchanger 14 (TOC) is brazed. Therefore, the valve bore 112 is formed in second segment 84B, as are the fifth and sixth oil ports 94, 96 which provide fluid communication between the valve bore 112 and the second heat exchanger 14.

In the present embodiment the first and second oil ports 86, 88 are also provided in the second segment 84B, with the third surface 106 of the housing 84 being defined in the second segment 84B, and being oriented opposite to the second surface 104, i.e. at about 180 degrees thereto. However, it is not required that oil ports 86, 88 are located in the same surface 106, or that this surface is arranged at 180 degrees to the second surfaces 104. Rather, the surface 106 can be oriented at more or less than 180 degrees to the surface 104. It will be appreciated that the valve mechanism 386 may instead be housed in the first segment 84A.

Figure 14:
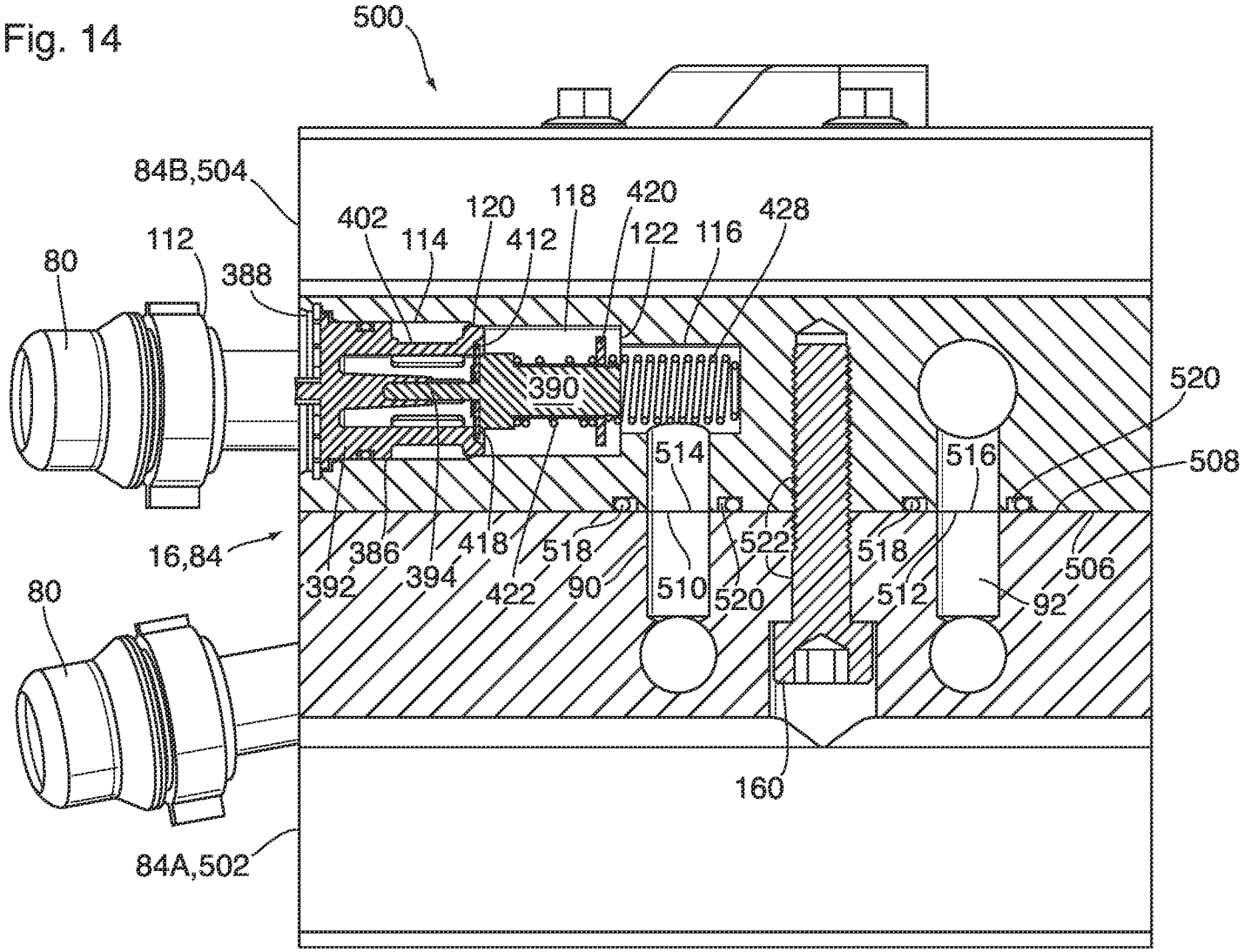
FIG. 14 is a cross-section along line 14-14' of FIG. 13.

As shown in the cross-section of FIG. 14, the second segment 84B includes portions of the third and fourth oil ports 90, 92 which provide fluid communication between the valve bore 112 and the first heat exchanger 12 (TOH). In this regard, the second segment 84B includes the interior openings and portions of the flow passages of the third and fourth oil ports 90, 92. Therefore, the third and fourth oil ports 90, 92 extend across the connection surfaces 506, 508 of the two segments 84A, 84B.

The connection surfaces 506, 508 of the two segments 84A, 84B are flat, with connection surface 506 including openings 510, 512 of the respective third and fourth oil ports 90, 92, and connection surface 508 including openings 514, 516 of respective third and fourth oil ports 90, 92. When the two segments 84A, 84B are sealingly joined together along the connection surfaces 506, 508, the openings 510, 514 of third oil port 90 are aligned with each other, and the openings 512, 516 of the fourth oil port 92 are aligned with each other, to permit fluid communication between the two segments 84A, 84B.

A resilient sealing element 518 such as an O-ring surrounds each aligned pair of openings 510, 514 and openings 512, 516 so as to prevent fluid leakage between the connection surfaces 506, 508. Each O-ring 518 may be received inside a circular groove 520 formed in one or both of the connection surfaces 506, 508.

The first segment 84A of housing 84 also includes portions of the third and fourth oil ports 90, 92, namely portions of the flow passages of oil ports 90, 92 extending between the connection surface 508 and the first surface 102, and the exterior openings of oil ports 90, 92 located at the first surface 102. As can be seen from the drawings, the first surface 102 and the connection surface 508 are at about 90 degrees to one another, and therefore the portions of third and fourth oil ports 90, 92 extending through the first segment 84A each include a 90-degree bend. In the present embodiment, the bend in each of the third and fourth oil ports 90, 92 comprises two bores intersecting at about 90 degrees, one of the bores extending inwardly from the first surface 102, and the other bore extending inwardly from the connection surface 508. These intersecting bores can be seen in FIG. 14.

The first and second segments 84A, 84B of housing 84 are joined together along surfaces 506, 508 by a plurality of threaded fasteners 160, such as bolts or screws. In the present embodiment, the fasteners 160 are received into bores 522 formed in the first and second segments 84A, 84B of the housing 84, portions of which are internally threaded.

The heat exchanger assembly 500 according to the present embodiment has the first and second heat exchangers 12, 14 arranged side-by-side and with the same orientation. However, it will be appreciated that this is not essential, and that the first and second heat exchangers 12, 14 could instead be oriented at any desired angle to each other. For example, it may be desired to orient the heat exchangers 12, 14 at about 90 degrees to each other. To accomplish this, the portions of third and fourth oil ports provided in the first portion 84A of housing 84 could be straight rather than bent. Also, it would be possible to orient the heat exchangers 12, 14 so that they face in opposite directions, for example by providing a first portion 84A which is rotated by 180 degrees in the plane of the connection surface 506, relative to the first portion 84A of the housing 84 in assembly 500.

The drawings show specific embodiments of heat exchanger assemblies in which the first and second heat exchangers 12, 14 are oriented side-by-side, or at 90 or 180 degrees to one another. However, the relative orientation of the heat exchangers 12, 14 depends at least partly on space constraints and the locations of fluid connections in the vehicle space where the assembly will be mounted. Therefore, the specific orientations shown in the drawings are illustrative only, and are not limiting. It will be appreciated that the angles between the first and second surfaces 102, 104 of valve housing 84, and the angles between the heat exchangers 12, 14, may vary from 0-360 degrees, depending on the specific application.

While the present invention has been illustrated and described with reference to specific exemplary embodiments of heat exchanger assemblies comprising a heat exchanger, a thermal valve integration unit and a pressure bypass valve assembly, it is to be understood that the present invention is not limited to the details shown herein since it will be understood that various omissions, modifications, substitutions and changes in the forms and details of the disclosed system and their operation may be made by those skilled in the art without departing in any way from the spirit and scope of the present invention. For instance, while heat exchanger assembly 10 has been described in connection with particular applications for cooling/heating transmission oil, it will be understood that any of the heat exchanger assemblies described herein can be used for various other heat exchange applications and should not be limited to applications associated with the transmission of an automobile system.

What is claimed is:

1. A heat exchanger assembly comprising:

(a) a first heat exchanger; comprising a core having a top and a bottom, the bottom of the core having first and second manifold openings;

(b) a second heat exchanger; comprising a core having a top and a bottom, the bottom of the core having first and second manifold openings;

(c) a control valve comprising a valve housing and first and second valve elements, the valve housing comprising:

(i) a first surface to which the first heat exchanger is attached;

(ii) a second surface to which the second heat exchanger is attached;

(iii) first and second fluid ports for connection to an external source of a first fluid;

(iv) third and fourth fluid ports provided in the first surface of the valve housing, the third fluid port providing fluid communication between the first fluid port and the first manifold opening of the first heat exchanger, and the fourth fluid port providing fluid communication between the second fluid port and the second manifold opening of the first heat exchanger;

(v) fifth and sixth fluid ports provided in the second surface of the valve housing, the fifth fluid port providing fluid communication between the first fluid port and the first manifold opening of the second heat exchanger, and the sixth fluid port providing fluid communication between the second fluid port and the second manifold opening of the second heat exchanger;

(vi) a first valve chamber in flow communication with the first or second manifold opening of the second heat exchanger, wherein the first valve element is configured to selectively block or allow flow of the first fluid through the first valve chamber to or from the second heat exchanger; and (vii) a second valve chamber in flow communication with the first or second manifold opening of the first heat exchanger, wherein the second valve element is configured to selectively block or allow flow of the first fluid through the second valve chamber to or from said first heat exchanger;

wherein the second, fourth and sixth fluid ports all open into a first interior space of the valve housing, the first interior space being in fluid communication with the first and second heat exchangers through the fourth and sixth fluid ports;

wherein the first, third and fifth fluid ports all open into a second interior space of the valve housing, the second interior space being in fluid communication with the first and second heat exchangers through the third and fifth fluid ports;

wherein the first and second valve elements are spaced apart along a longitudinal axis and are movable along the longitudinal axis;

wherein the first and second valve elements are both attached to a thermal actuator which is located between the first and second valve seats;

wherein the first and second valve elements are movable together along with the actuator between their respective first and second positions; and wherein the valve housing further comprises a third valve chamber located between the first and second valve chambers, wherein the third valve chamber contains an interior opening of the first fluid port, and also contains the thermal actuator.

2. The heat exchanger assembly of claim 1, wherein the first and second interior spaces are spaced apart from one another along a longitudinal axis and are fluidly isolated from one another.

3. The heat exchanger assembly of claim 2, wherein the first and second valve elements and the first and second valve chambers are located within the second interior space, and wherein the first valve element and the first valve chamber are spaced apart from the second valve element and the second valve chamber along the longitudinal axis.

4. The heat exchanger assembly of claim 1, wherein the control valve includes a first valve seat located between the first fluid port and the fifth fluid port, wherein the first valve element is movable between a first position in which it sealingly engages the first valve seat to block fluid flow through the first valve chamber, and a second position in which it is spaced from the first valve seat to permit fluid flow through the first valve chamber; and wherein the control valve includes a second valve seat located between the first fluid port and the third fluid port, wherein the second valve element is movable between a first position in which it is spaced from the second valve seat to permit fluid flow through the second valve chamber, and a second position in which it sealingly engages the second valve seat to block fluid flow through the second valve chamber.

5. The heat exchanger assembly of claim 1, wherein the valve body and the second heat exchanger comprise a unitary first sub-assembly, the components of which are joined by brazing; and wherein the first heat exchanger is mechanically secured to the first surface of the valve housing.

6. The heat exchanger assembly of claim 1, the bottom of the first heat exchanger is joined to a first surface of an adapter plate, wherein the first heat exchanger and the adapter plate comprise a unitary second sub-assembly, the components of which are joined by brazing;

wherein the adapter plate has a second surface which is mechanically sealed to the first surface of the valve housing, the adapter plate comprising a pair of openings to provide fluid communication between the third and fourth fluid ports and the first and second manifold openings of the first heat exchanger.

7. The heat exchanger assembly of claim 6, wherein the adapter plate includes a peripheral edge extending outwardly of a periphery of the first heat exchanger, the peripheral edge having a plurality of apertures which align with threaded bores in the valve body, and wherein the adapter plate is secured to the valve body by a plurality of threaded fasteners.

8. The heat exchanger assembly of claim 1, wherein the first and second surfaces are located on opposite sides of the valve body and are parallel to one another, such that the first and second heat exchangers are located on opposite sides of the valve body; and wherein the valve body further comprises a third surface in which at least one of the first and second fluid ports are provided.

9. The heat exchanger assembly of claim 1, wherein the first heat exchanger is brazed or mechanically secured to the first surface of the valve housing, and the second heat exchanger is brazed or mechanically secured to the second surface of the valve housing.

10. The heat exchanger assembly of claim 1, wherein the first and second surfaces of the valve housing are arranged at about 90 degrees to one another, such that the first and second heat exchangers are arranged at about 90 degrees to one another; and wherein the valve body further comprises a third surface in which the first and second fluid ports are provided, wherein the third surface is arranged at about 180 degrees to one of the first and second surfaces.

11. The heat exchanger assembly of claim 1, wherein the heat exchanger assembly comprises a first sub-assembly and a second sub-assembly, and the valve housing comprises a first valve housing segment and a second valve housing segment;

wherein the first valve housing segment includes the first surface of the valve housing and the second valve housing segment includes the second surface of the valve housing;

wherein the first sub-assembly comprises the first heat exchanger and the first valve housing segment, and the second sub-assembly comprises the second heat exchanger and the second valve housing segment;

wherein the first valve housing segment includes a first connection surface and the second valve housing segment includes a second connection surface; and wherein the first and second sub-assemblies are mechanically joined together along the first and second connection surfaces.

12. The heat exchanger assembly of claim 11, wherein the first and second valve elements, the first and second valve chambers, and the first and second fluid ports are all located in the second valve housing segment.

13. The heat exchanger assembly of claim 11, wherein the third and fourth fluid ports extend across the first and second connection surfaces.

14. The heat exchanger assembly of claim 13, wherein the first surface of the first valve housing segment is at 90 degrees to the first connection surface, and the second surface of the second valve housing segment is at 90 degrees to the second connection surface, such that the first and second surfaces are side-by-side.

15. The heat exchanger assembly of claim 14, wherein each of the third and fourth fluid ports includes a 90 degree bend.

16. The heat exchanger assembly of claim 1, further comprising:

a bypass flow passage providing fluid communication between the first interior space and the second interior space; and a pressure-actuated bypass valve element to selectively block or allow flow of the first fluid through the bypass flow passage from the first interior space to the second interior space;

wherein the bypass valve element is actuated by a high pressure condition in which there is a predetermined pressure drop between the first interior space and the second interior space.

17. A heat exchanger assembly comprising:

(a) a first heat exchanger; comprising a core having a top and a bottom, the bottom of the core having first and second manifold openings;

(b) a second heat exchanger; comprising a core having a top and a bottom, the bottom of the core having first and second manifold openings;

(c) a control valve comprising a valve housing and first and second valve elements, the valve housing comprising:

(i) a first surface to which the first heat exchanger is attached;

(ii) a second surface to which the second heat exchanger is attached;

(iii) first and second fluid ports for connection to an external source of a first fluid;

(iv) third and fourth fluid ports provided in the first surface of the valve housing, the third fluid port providing fluid communication between the first fluid port and the first manifold opening of the first heat exchanger, and the fourth fluid port providing fluid communication between the second fluid port and the second manifold opening of the first heat exchanger;

(v) fifth and sixth fluid ports provided in the second surface of the valve housing, the fifth fluid port providing fluid communication between the first fluid port and the first manifold opening of the second heat exchanger, and the sixth fluid port providing fluid communication between the second fluid port and the second manifold opening of the second heat exchanger;

(vi) a first valve chamber in flow communication with the first or second manifold opening of the second heat exchanger, wherein the first valve element is configured to selectively block or allow flow of the first fluid through the first valve chamber to or from the second heat exchanger; and (vii) a second valve chamber in flow communication with the first or second manifold opening of the first heat exchanger, wherein the second valve element is configured to selectively block or allow flow of the first fluid through the second valve chamber to or from said first heat exchanger;

wherein the bottom of the first heat exchanger is joined to a first surface of an adapter plate, wherein the first heat exchanger and the adapter plate comprise a unitary second sub-assembly, the components of which are joined by brazing;

wherein the adapter plate has a second surface which is mechanically sealed to the first surface of the valve housing, the adapter plate comprising a pair of openings to provide fluid communication between the third and fourth fluid ports and the first and second manifold openings of the first heat exchanger;

wherein the adapter plate includes a peripheral edge extending outwardly of a periphery of the first heat exchanger, the peripheral edge having a plurality of apertures which align with threaded bores in the valve body, and wherein the adapter plate is secured to the valve body by a plurality of threaded fasteners;

wherein the third and fourth fluid ports are offset from the respective first and second manifold openings of the first heat exchanger;

wherein the adapter plate includes a pair of transfer channels, each of the transfer channels comprising of trough protruding away from the bottom of the heat exchanger and extending parallel to the bottom of the first heat exchanger from one of the third and fourth fluid ports to the associated first or second manifold opening of the first heat exchanger; and wherein the first surface of the valve body includes a recessed portion in which the third and fourth fluid ports are provided, the recessed portion receiving the transfer channels of the adapter plate.

* * * * *